US011794082B1

(12) United States Patent
Tsuji et al.

(10) Patent No.: US 11,794,082 B1
(45) Date of Patent: Oct. 24, 2023

(54) GOLF CLUB HEAD WITH SOLE SIDE FEATURES

(71) Applicant: Mizuno Corporation, Osaka (JP)

(72) Inventors: Kei Tsuji, Osaka (JP); David Gregory Llewellyn, Norcross, GA (US)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 17/831,583

(22) Filed: Jun. 3, 2022

(51) Int. Cl.
*A63B 53/08* (2015.01)
*A63B 53/04* (2015.01)

(52) U.S. Cl.
CPC ..... *A63B 53/08* (2013.01); *A63B 53/0433* (2020.08); *A63B 53/0437* (2020.08); *A63B 53/0466* (2013.01); *A63B 2053/0491* (2013.01); *A63B 2209/00* (2013.01)

(58) Field of Classification Search
CPC . A63B 53/08; A63B 53/0433; A63B 53/0437; A63B 53/0466; A63B 2053/0491; A63B 2209/00
See application file for complete search history.

(56) References Cited

U.S. PATENT DOCUMENTS 4,043,563 A * 8/1977 Churchward ..... A63B 53/0466 473/338
6,217,461 B1 * 4/2001 Galy ..... A63B 60/00 473/328
6,440,009 B1 * 8/2002 Guibaud ..... A63B 53/0466 473/349
6,458,044 B1 * 10/2002 Vincent ..... A63B 53/04 473/409
7,530,901 B2 * 5/2009 Imamoto ..... A63B 53/0466 473/347
8,870,679 B2 * 10/2014 Oldknow ..... A63B 53/0466 473/335
9,101,808 B2 * 8/2015 Stites ..... A63B 60/00
9,498,688 B2 * 11/2016 Galvan ..... A63B 53/06
9,550,097 B1 * 1/2017 Myers ..... A63B 53/06
9,623,302 B1 * 4/2017 Myers ..... A63B 53/0466
9,662,550 B2 * 5/2017 Oldknow ..... A63B 53/06
9,868,036 B1 * 1/2018 Kleinert ..... A63B 53/06
9,925,432 B2 * 3/2018 Morales ..... A63B 53/0475
(Continued)

OTHER PUBLICATIONS

International Search Report and Written Opinion dated Jul. 20, 2023 issued in PCT Application No. PCT/US2023/024284.

*Primary Examiner* — William M Pierce
(74) *Attorney, Agent, or Firm* — TROUTMAN PEPPER HAMILTON SANDERS LLP; James E. Schutz; Korbin Blunck

(57) ABSTRACT

A golf club head can comprise a hollow body comprising a shell defining at least some of an exterior surface of the golf club head, and the hollow body can include a ball-striking face, a crown, a hosel, a sole, and a rear end opposite the ball-striking face. A recess can be located on the sole and can extend toward an interior of the hollow body. An opening can be located within the recess and can be defined by one or more sidewalls. A weighted insert can insert into the recess and the opening and can comprise a first end, a second end, and a middle portion disposed therebetween. The first end can extend outwardly from the middle portion in a toe-to-heel direction and the second end can extend outwardly from the middle portion in a heel-to-toe direction. A weight can be disposed within the weighted insert.

20 Claims, 26 Drawing Sheets

(56) References Cited

U.S. PATENT DOCUMENTS 9,975,019 B2 * 5/2018 Frame ..... A63B 53/0466
10,046,211 B2 * 8/2018 Franklin ..... A63B 53/065
10,343,032 B2 * 7/2019 Martens ..... A63B 60/02
10,688,353 B2 * 6/2020 Norimura ..... A63B 53/047
10,806,978 B2 * 10/2020 Golden ..... A63B 53/06
10,843,046 B2 * 11/2020 Bennett ..... A63B 53/04
10,926,143 B2 * 2/2021 Bennett ..... A63B 60/02
11,090,536 B2 * 8/2021 Bennett ..... A63B 53/06
11,406,881 B2 * 8/2022 Harbert ..... A63B 53/0433
2002/0165041 A1 * 11/2002 Takeda ..... A63B 60/02
473/349
2003/0032499 A1 * 2/2003 Wahl ..... A63B 53/047
473/334
2004/0023729 A1 * 2/2004 Nagai ..... A63B 53/04
473/338
2005/0049075 A1 * 3/2005 Chen ..... A63B 53/047
473/338
2005/0119070 A1 * 6/2005 Kumamoto ..... A63B 53/0466
473/345
2005/0227781 A1 * 10/2005 Huang ..... A63B 53/04
473/349
2009/0062032 A1 * 3/2009 Boyd ..... A63B 53/047
473/409
2011/0021285 A1 * 1/2011 Shimazaki ..... A63B 60/02
473/332
2013/0344988 A1 * 12/2013 Hettinger ..... A63B 60/00
72/352
2014/0248976 A1 * 9/2014 Stokke ..... A63B 53/06
473/335
2018/0065005 A1 * 3/2018 Cleghorn ..... A63B 53/0466
2018/0264330 A1 * 9/2018 Kitagawa ..... A63B 53/0466
2021/0260447 A1 * 8/2021 Penney ..... A63B 53/04
2022/0032135 A1 * 2/2022 Kato ..... A63B 53/0466
2022/0347528 A1 * 11/2022 Hoffman ..... A63B 60/00
2023/0064631 A1 * 3/2023 Sanchez ..... A63B 53/08
2023/0072814 A1 * 3/2023 Hettinger ..... A63B 53/06

* cited by examiner

GOLF CLUB HEAD WITH SOLE SIDE FEATURES

FIELD OF THE DISCLOSED TECHNOLOGY

The disclosed technology relates generally to golf club heads and, more particularly, to a wood-type golf club head (e.g., a hollow golf club head) having one or more sole side features.

BACKGROUND

Current driver and fairway wood golf club heads are typically formed of steel or titanium alloys. Oversize driver heads exceeding 300 cc in volume, for example, are usually formed of a lightweight titanium alloy such as Ti 6A1-4V. Unless modified, however, oversize heads can have a relatively high center of gravity (COG), which can adversely affect launch angle, spin, and flight trajectory of a golf ball. Generally, club heads are back-weighted to provide a higher moment of inertia (MOI), but this generally causes a deeper (farther from the face in the face-to-rear direction) COG, which can in turn project a higher "sweet spot" on the face. A high sweet spot can provide an undesirably high amount of backspin on the ball after contact, which can negatively impact ball flight distance and other characteristics. Thus, many club heads have slots or weight pads, for example, cast into the head to lower the club's center of gravity and move the center of gravity closer to the front of the club (i.e., near the ball-striking face).

Several golf clubs currently on the market include sole features located proximate the face that are intended to improve golf ball launch conditions as well as lower the club's center of gravity. These sole features are often slots or grooves having parallel side walls, as shown in FIGS. 1 and 2. In this example, the body of club head 10 may include a ball striking face 12, a sole 14, and a slot 16. The slot 16 has sidewalls 18 having a height 19, and an upper wall 20 having a width 21. Because it adds flexibility to the face 12, the slot 16 can also improve the coefficient of restitution (COR), which can result in improved ball launch properties.

Attempts to improve performance using this design have included adding weight directly to the sole 14 of the club, or indirectly by increasing the slot height 19, the slot width 21, and/or increasing the thickness of the upper wall 20. Increases in the slot height 19, however, generally result in raising the club's COG. This also increases the difficulty of removing the club head from the mold during the manufacturing process. Increasing the width 21, on the other hand, can increase the likelihood of unwanted turf interaction with the club (e.g., snagging) during play. Increases in the thickness of the upper wall 20 or the sole 14 are common but the effectiveness of providing a desirably balanced club head (e.g., to affect a desired MOI and/or COG) and/or to provide a sufficiently low sweet spot location on the face of the club head is often limited. Thus, although this design may improve COR, it does so at the expense of control over the COG location and/or sweet spot location.

These slot structures are typically selected for ease of manufacture, but they do not provide optimized ball launch conditions. Furthermore, as discussed above, the design of these slot structures is limited because attempting to cast a thicker wall or deeper slots, for example, can cause casting defects and other manufacturing issues. As a result of these limitations, traditional slot designs are limited in the extent to which they can improve the COR and move the COG. Moreover, traditional slot designs serve to remove mass from a location that is low and near the face of the club head, which can negatively impact the ability of the club head to provide a MOI, COG, and/or sweet spot location that can sufficiently increase performance of the club head.

Certain club heads have been designed to improve the mass distribution of the club head, but such designs often tend to undesirably transmit stresses to various points within the club head, which can decrease the working life of the club head. More recently, some designs, can include various structures molded or cast into the sole, crown, or other portions of the club head and can thus redistribute stress throughout the club head (e.g., as compared to traditional club heads), but some of these and/or other designs can result in the occurrence of undesirable vibrations when the club head impacts a ball, which can cause discomfort for a player using the club head. Moreover, some of these and/or other designs can limit manufacturability, as the increasingly complex structures can, for example, increase the difficulty of disassembling molds during manufacturing, which can slow cycle times.

What is needed, therefore, is a golf club construction that provides improved golf ball launch conditions while ensuring a sweet spot location that is sufficiently low on the face of the club head. Also, there is a need for a golf club construction that offers greater control over the COG and COR. In addition, the club should be easily castable using conventional casting techniques. Further, the club should have a construction that allows for the reduction of stress concentrations during the ball striking event.

BRIEF SUMMARY

These and other problems can be addressed by the technologies described herein. The present disclosure relates generally to wood-type golf clubs, and particularly to golf club heads comprising a head having a ball-striking face, a crown, a sole, a rear opposite the ball-striking face, and a skirt connecting the ball-striking face, crown, sole, and rear to form a hollow structure. The sole can include one or more features for adding additional weight to the head of the golf club.

The disclosed technology includes a golf club head comprising a hollow body comprising a shell defining at least some of an exterior surface of the golf club head. The hollow body can include a ball-striking face, a crown, a hosel, a sole, and a rear end opposite the ball-striking face. The golf club head can include a recess located on the sole. The recess can extend inwardly toward an interior of the hollow body. The golf club head can include an opening located within the recess and extending inwardly toward the interior of the hollow body. The opening can be defined by one or more sidewalls. The golf club head can include a weighted insert configured to insert into the recess and the opening.

The weighted insert can comprise an insert body having a first end, a second end, and a middle portion disposed between the first end and the second end. The first end can extend outwardly from the middle portion in a toe-to-heel direction and the second end can extend outwardly from the middle portion in a heel-to-toe direction. The weighted insert can include a weight disposed within the weighted insert body.

Alternatively, or in addition, the weighted insert can comprise a middle portion having a first end and a second end. The weighted insert can comprise a first wing extending outwardly from the first end in a direction that extends at least partially in a toe-to-heel direction and at least partially in a front-to-rear direction. The weighted insert can include a second wing extending outwardly from the second end in a direction that extends at least partially in a heel-to-toe direction and at least partially in the front-to-rear direction.

At least one of the first and second wings can have a first width at a proximal end relative the middle portion and a second width at a distal end relative the middle portion, and the first and second widths can be measured in the front-to-rear direction. At least one of the first and second wings can taper from the first width to the second width.

The first wing can have the first width and the second width, the proximal end can be a first proximal end, and the distal end can be a first distal end. The second wing can have a third width at a second proximal end relative the middle portion and a fourth width at a second distal end relative the middle portion, with the third and fourth widths being measured in the front-to-rear direction. The third width can be different from the first width. Alternatively or in addition, the fourth width can be different from the second width.

The recess can have a cross-sectional shape that is the same as the cross-sectional shape of the weighted insert such that one or more exterior surfaces of the weighted insert contact one or more walls of the recess.

A rearmost portion of a leading edge of the middle portion of the weighted insert can be nearer the ball-striking face than a forwardmost portion of one of the first and second ends. The rearmost portion of the leading edge of the middle portion of the weighted insert can be nearer the ball-striking face than the forwardmost portion of both the first and second ends.

The weighted insert can be symmetrical along a plane extending in a sole-to-crown direction and the front-to-rear direction.

A minimum width of the middle portion of the weighted insert can be located at or near a midpoint of the middle portion. Alternatively or in addition, the minimum width of the middle portion of the weighted insert can be located at a centerline of the ball-striking face.

The weighted insert can comprise a protrusion extending from an inner-facing surface of the weighted insert. The protrusion can be configured to extend at least partially into the opening of the recess. The protrusion of the weighted insert can comprise a lip configured to abut one or more surfaces of a sidewall of the opening to thereby retain the weighted insert within the opening. The protrusion of the weighted insert can comprise a resiliently deformable material. The weighted insert can comprise a resiliently deformable material and a UV-resistant additive.

The shell can comprise a unitary piece forming at least (i) a perimeter of the ball-striking face, (ii) the hosel, and (iii) a skirt positioned between the crown and sole and extending around a rear perimeter portion of the hollow body that extends between a front-heel portion of the hollow body and a front-toe portion of the hollow body. The rear perimeter portion can comprise the rear end of the hollow body.

The shell can comprise a sole opening and a crown opening, and the golf club head can comprise a sole insert configured to attach to the shell and cover the sole opening and a crown insert configured to attach to the shell and cover the crown opening.

The weight can comprise a material having a density that is greater than a density of the weighted insert.

The shell can comprise a channel located rearwardly from the recess. The shell can comprise one or more trusses or ribs located the interior of the hollow body. Some or all of the one or more trusses (or ribs) can extend between an interior surface of the recess and an interior surface of the channel.

The shell can comprise a protrusion extending outwardly from the shell. The protrusion can include a weight opening, and the golf club head can comprise a secondary weight configured to at least partially insert into the weight opening. The secondary weight can extend into the interior of the hollow body, and/or the secondary weight can have a generally longitudinal shape.

The disclosed technology can include a golf club head having a hollow body comprising a shell defining at least some of an exterior surface of the golf club head. The hollow body can include a ball-striking face, a crown, a hosel, a sole, and a rear end opposite the ball-striking face. The golf club head can include a recess located on the sole. The recess can extend inwardly toward an interior of the hollow body. The golf club head can further include an opening located within the recess and extending inwardly toward the interior of the hollow body. The opening can be defined by one or more sidewall. The golf club head can include a weighted insert configured to insert into the recess and the opening. The weighted insert can comprise a resiliently deformable material and a UV-resistant additive.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

Figure 1:
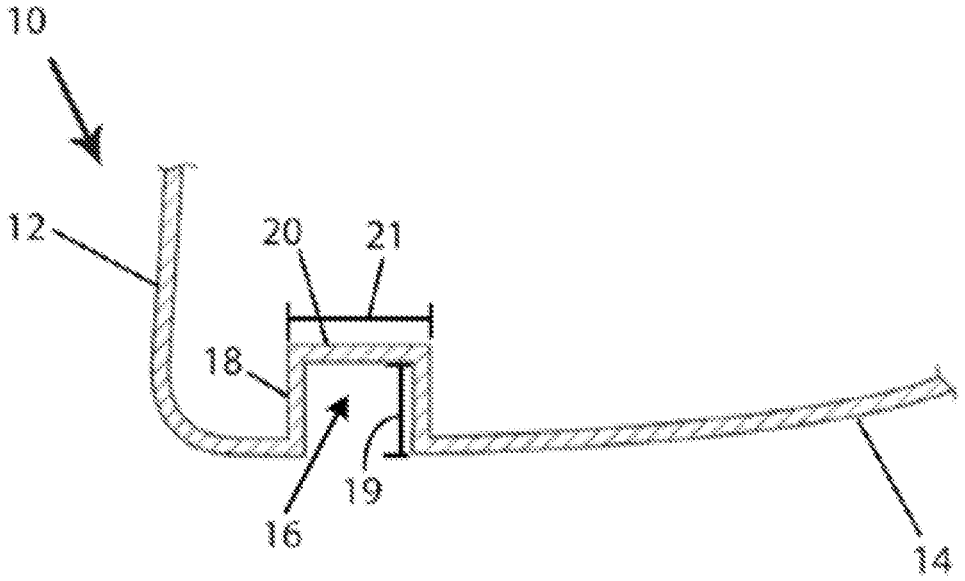
FIG. 1 PRIOR ART
FIG. 1 is a cross-sectional view of a prior art golf club having a first sole groove configuration.
Figure 2:
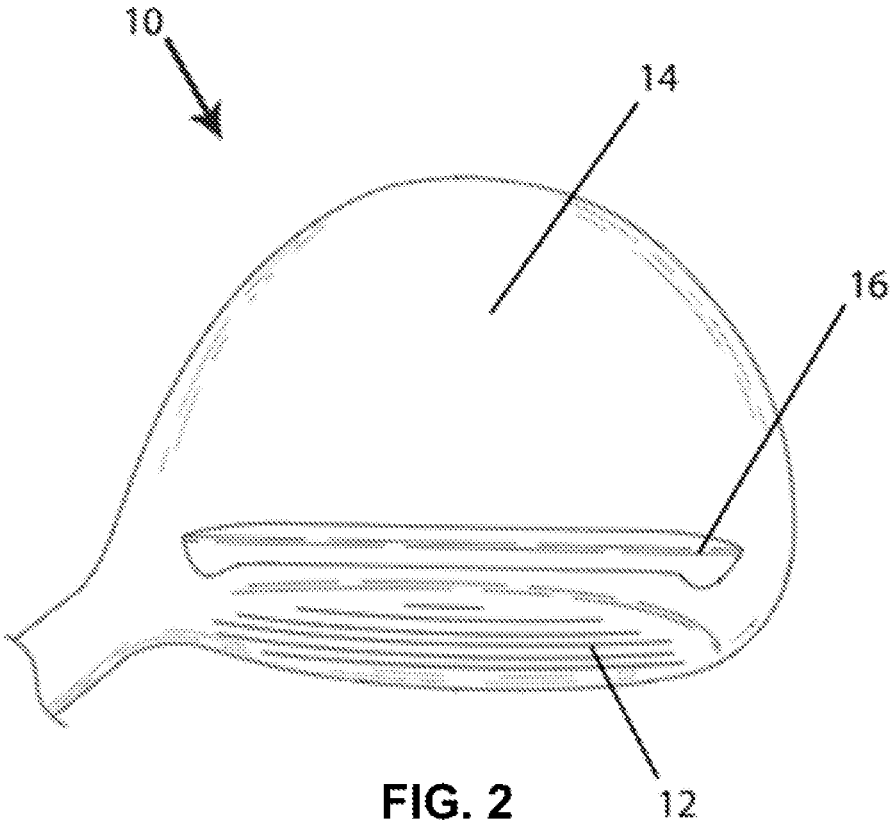
FIG. 2 PRIOR ART
FIG. 2 is a bottom perspective view of the prior art golf club of FIG. 1.
Figure 3:
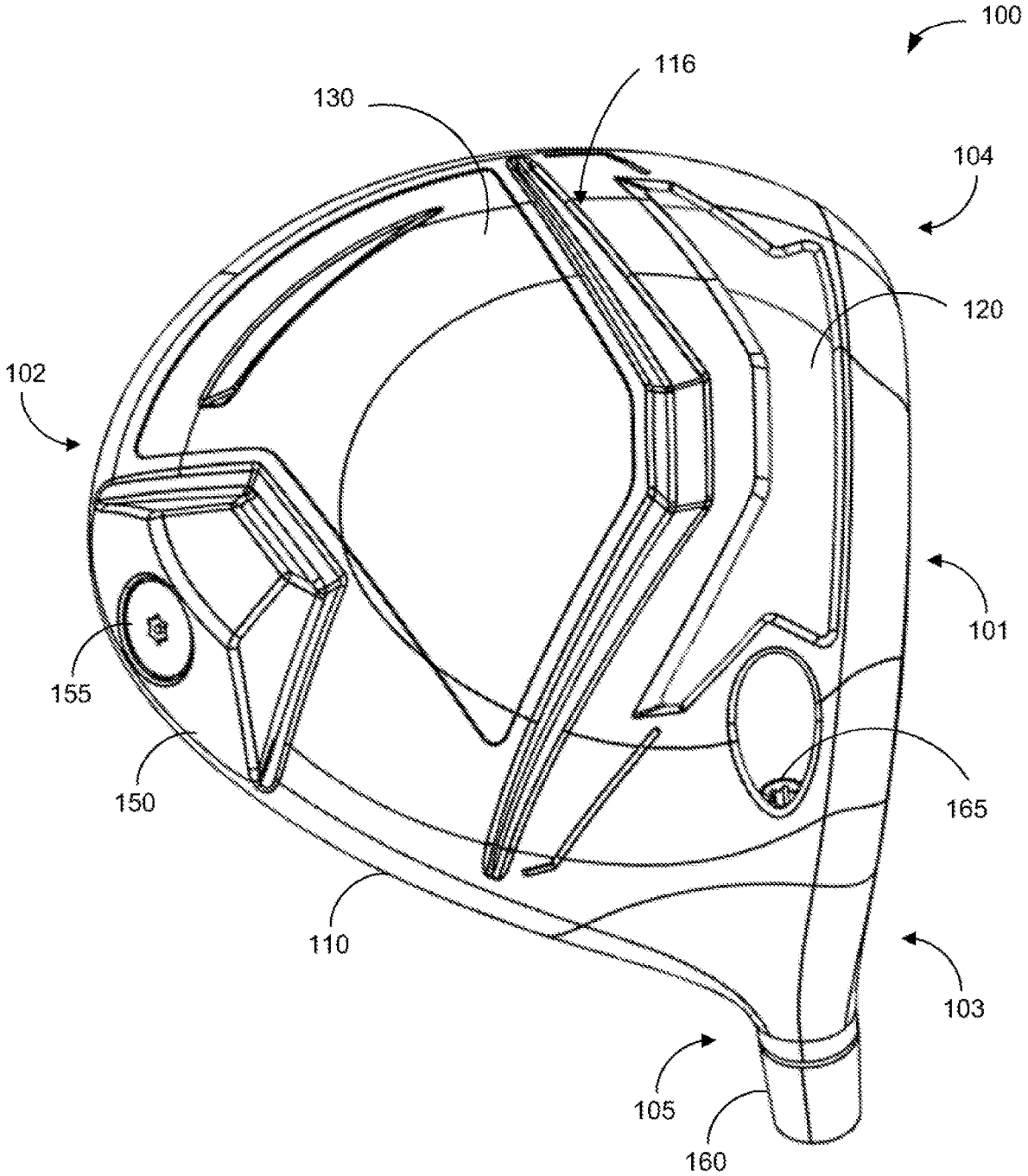
FIG. 3 is a bottom heel-side perspective view of an example club head, in accordance with the disclosed technology.
Figure 4:
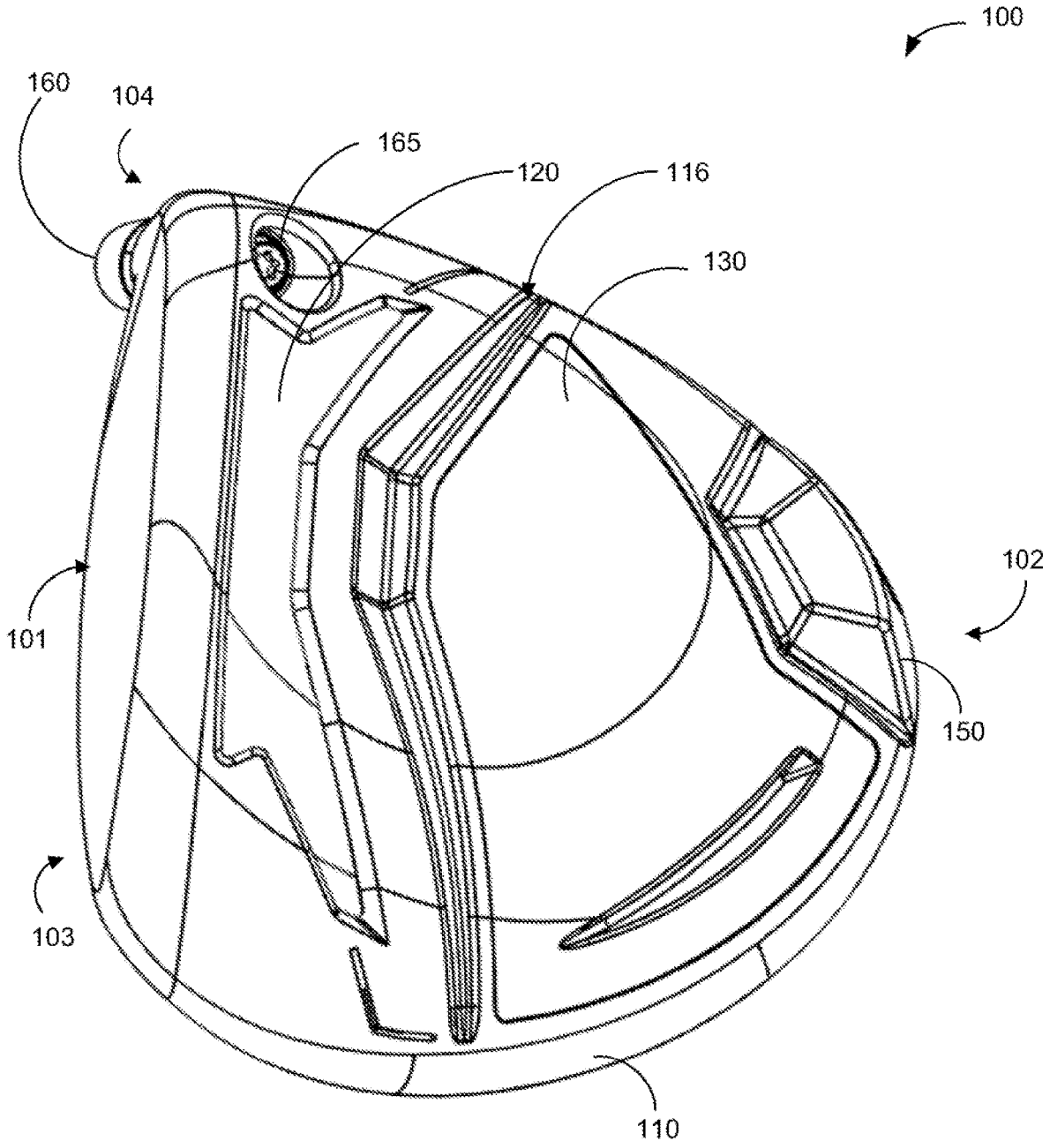
FIG. 4 is a bottom toe-side perspective view of an example club head, in accordance with the disclosed technology.

The detailed description explains exemplary embodiments of the invention, together with advantages and features, by way of example with reference to the drawings.

DETAILED DESCRIPTION

The disclosed technology includes golf club heads one or more features on the sole for reducing vibration of the club head during and/or following impact with a golf ball, reducing stress experienced by the club head during and/or following impact with a golf ball, and/or reducing the resulting spin imparted to a ball (e.g., by distributing mass within the club head such that the center of gravity is near the sole and ball-striking face).

As will be described more fully herein, the club head can have a generally skeletal shell, and weight can be added to a bottom front region by using a weight. The weight can be included in, or integrated into, an insert that comprises one or more elastic and/or polymeric materials. The weight slot can include, for example, wave shapes in order to increase the weight of the slot without adding to the thickness of the slot wall. In some embodiments, the weight slot may include two or more wave shapes. The club head can include one or more outer pieces that can attach to the shell to form at least a portion of the outer surface of the club head, such as some or all of the crown and/or sole. The club head can include a counterweight positioned rearwardly from the insert, such as at or near a rear portion of the club head that is opposite the ball-striking face. The club head can include an adapter at the hosel of the club head, which can enable a shaft to be attached to the club head. Although the discussion herein focuses primarily on the club head, the present disclosure contemplates a golf club including any club head described herein, such that the disclosed technology includes a golf club comprising a shaft having a grip and being connected to any of the disclosed club heads.

To simplify and clarify explanation, the invention is described herein as a wood-type golf club. One skilled in the art will recognize, however, that the invention is not so limited. The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

As described above, a general problem with conventional golf clubs is that adjusting the height of the sweet spot on the face of the club head is often limited by the ability to increase the thickness of the wall or the depth of a slot feature on the sole of the club head. This can be due to conventional manufacturing techniques, which restrict the wall thickness that can be used without manufacturing defects or limit the depth of the weight slot due to casting limitations. Further, deeper slot features can result in increasing the height of the sweet spot on the face of the club. This limits the extent to which the COG can be moved forwards. Some designs add weights or the like to the club head, but these designs can result in undesirable vibrations during use and/or can require difficult and/or expensive manufacturing methods.

In an effort to solve these problems and referring now to the drawings, and particularly to FIGS. 3-8, the disclosed technology includes a club head 100 having a ball-striking face 101, a rear 102 opposite the ball-striking facing 101, a heel end 103, and a toe end 104. A hosel 105 can be located at the heel end 103. The club head 100 includes a shell 110 that provides structure for the club head 100. That is to say, the shell 110 can be a skeletal component configured to at least partially receive one or more components to define the exterior surface(s) of the club head 100. The shell 110 can form at least some of the exterior surface(s) of the club head 100. For example, the shell 100 can be integral with the ball-striking face 101. Alternatively, the ball-striking face 101 can be a separate component that can at least partially insert into and/or attach to the shell 110. The ball-striking face 101 can have a constant thickness. Alternatively, the ball-striking face 101 can have a variable thickness such that one portion of the ball-striking face 101 has a minimum thickness and another portion of the ball-striking face 101 has a maximum thickness. The shell 110 can be made from (or comprise) metal, for example, and can comprise titanium, aluminum, titanium alloys, aluminum alloys, steels (e.g., stainless steels), and the like. Alternatively or in addition, the shell 110 can be made from (or comprise) a composite material, such as a fiber-polymer composite, a resin, or any other useful material. The shell 110 can be a unitary piece, which can help reduce overall vibration of the assembled club head 100. Alternatively, the shell 110 can be assembled from two or more pieces, which can help improve ease of molding or the like during manufacturing.

The club head 100 can include an insert 120 located rearwardly from the ball-striking face 101. The location and shape of the insert 120 can impact the coefficient of gravity and/or coefficient of restitution of the club head 110, among other things. At least some of the insert 120 can be generally parallel the ball-striking face 101. The insert 120 can be symmetrical (e.g., with respect to a plane extending between the sole and the crown and between the ball-striking face 101 and the rear 102) or substantially symmetrical. Alternatively and as illustrated, the insert 120 can be asymmetrical. The insert can comprise a plastic or another elastic material. For example, the insert 120 can be made from (or comprises) polyurethane (e.g., thermoplastic polyurethane), polypropylene, or the like. As an example, the insert 120 can include a substantially transparent or translucent thermoplastic polyurethane, which can enable visibility of internal components, such as a weight 125 located within the insert 120, as will be described more fully herein. The exterior surface of the insert 120 can have a curvature that follows the surrounding curvature of the club head 100 (e.g., the curvature of the shell 110 at the regions immediately surrounding the insert 120. Some or all of the insert 120 can be flush with the portions of the club head (e.g., shell 110) neighboring the insert 120. Alternatively or in addition, some or all of the insert 120 can be recessed from the neighboring portions of the club head (e.g., shell 110).

The width of the insert 120 (face-to-rear direction) can vary across the heel-to-toe direction of the club head 100. For example, as illustrated, the width of the insert 120 can have a local width minima at or near the center line of the ball-striking face 101, and the width of the recess can increase along the center-to-heel direction and/or center-to-toe direction. The width of the insert 120 can increase until a certain point is met, such as the end of the middle portion of the insert 120. Alternatively or in addition, the width of the insert 120 can increase until a location is reached in the heel-to-toe direction that matches, or approximately matches, the location at which the grooves on the ball-striking face 101 end. Then, continuing in the center-to-heel direction and/or center-to-toe direction the width can decrease, gradually or otherwise (e.g., until another local width minima is reached). The minimum width of the insert 120 can be at or near the end of the wings of the recess 112.

The insert 120 can include an insert weight 125. The insert weight 125 can be substantially or fully submerged within the material of the insert 120. As can be seen most clearly from FIG. 18, the insert weight 125 can have a generally I-beam cross-sectional shape, which can help ensure sufficient surface contact between the insert weight 125 and the insert 120. That being said, other cross-sectional shapes are contemplated, such as any polygonal shape. The insert weight 125 can comprise a dense material, such as tungsten or stainless steel. The insert weight 125 can have a density that is at least approximately four times greater than the density of insert 120 (i.e., excluding the insert weight 125). Alternatively or in addition, the insert weight 125 can have a density that is at least approximately seven times greater than the density of the insert 120.

The shell 110 can include a recess 112 positioned rearwardly from the ball-striking face 101. The recess 112 can be configured to receive some or all of the insert 120. The recess 112 can include a middle portion that can be approximately parallel to at least a portion of the ball-striking face 101 (e.g., at or near the center of the ball-striking face 101, at or near the "sweet spot" or ideal contact location of the ball-striking face 101). Alternatively, the middle portion can be offset from the center and/or "sweet spot" of the ball-striking face 101. The recess 112 can include a wing on either side of the middle portion. The middle portion can have a first shape (e.g., triangular, trapezoidal, square, rectangular), and one or both of the of wings can have a second shape (e.g., triangular, trapezoidal, square, rectangular); the wings can have the same or different shapes. The wings can be substantially the same such that the recess 122 is symmetrical (e.g., with respect to a plane extending between the sole and the crown and between the ball-striking face 101 and the rear 102) or substantially symmetrical. Alternatively, the wings can have different sizes and/or shapes such that the recess 112 is asymmetrical. The wings can extend to the rear and outwardly. That is to say, the heel-side wing can extend from the middle portion in a direction that is at least partially extending toward the heel end 103 and/or at least partially extending toward the rear 102. Likewise, the toe-side wing can extend from the middle portion in a direction that is at least partially extending toward the toe end 104 and/or at least partially extending toward the rear 102. The wings can extend in a straight or substantially straight line. Alternatively, the wings can curve. One or both of the ends of the recess 112 (e.g., the tips of the wings at the toe side and/or heel side) can be open-ended. Alternatively or in addition, one or both of the ends of the recess 112 can be recessed relative the neighboring external surface(s) of the club head 100.

The forward-most portion of a given wing can be offset rearwardly from a nearest forwardmost portion of the middle portion. That is to say, the rearmost portion of the leading edge of the middle portion can be nearer the ball-striking face than the forwardmost portion of one or both wings. Alternatively or in addition, the toe-most and/or heel-most portion(s) of the leading edge of the middle portion can transition directly into the centermost portions of the leading edge of one or both of the wings.

The recess 112 can include an opening 114 that can extend into the inner volume of the club head 100. The opening 114 can be configured to receive a protrusion of the insert 120, as will be described more fully herein. The opening 114 can be configured to receive some or all of the insert 120. The opening 114 can have the same, or substantially the same outer shape and/or geometry as some or all of the outer edges of the recess 112. For example, the opening 114 can have the same size (e.g., area when viewed from the sole) and shape as the recess 112. Alternatively, the opening 114 can have a smaller size (e.g., area when viewed from the sole) than the recess 112, and/or the opening 114 can have a shape different from the shape of the recess 112. As depicted, the cross-sectional shape of the opening 114 can be generally trapezoidal. Alternatively, the cross-sectional shape of the opening 114 can be rectangular, square, triangular, or any other shape.

The maximum face thickness of the club head 100 can be in a range between approximately 3 mm and approximately 4 mm (e.g., approximately 3.6 mm), in a range between approximately 2 mm and approximately 3 mm (e.g., approximately 2.25 mm), or in a range between approximately 1 mm and approximately 2 mm (e.g., approximately 1.9 mm).

The width of the recess 112 (front-to-rear direction) can be in a range between approximately 8 mm and approximately 9 mm (e.g., approximately 8.6 mm), in a range between approximately 7 mm and approximately 8 mm (e.g., approximately 7.4 mm), or in a range between approximately 6 mm and approximately 7 mm (e.g., approximately 6.2 mm).

The width of the opening 114 (front-to-rear direction) can be in a range between approximately 5 mm and approximately 7 mm (e.g., approximately 6 mm) or in a range between approximately 3 mm and approximately 5 mm (e.g., approximately 3.9 mm).

The length of the opening 114 (toe-to-heel direction) can be in a range between approximately 45 mm and approximately 60 mm (e.g., approximately 53.8 mm), in a range between approximately 30 mm and approximately 45 mm (e.g., approximately 35.5 mm), or in a range between approximately 20 mm and approximately 35 mm (e.g., approximately 30.1 mm).

The insert 120 can have a length (toe-to-heel direction) that can be in a range between approximately 45 mm and approximately 60 mm (e.g., approximately 54.4 mm), in a range between approximately 30 mm and approximately 45 mm (e.g., approximately 40 mm), or in a range between approximately 20 mm and approximately 35 mm (e.g., approximately 31.1 mm).

The insert 120 can have a width (front-to-rear direction) that can be in a range between approximately 4 mm and approximately 6 mm (e.g., approximately 5 mm), in a range between approximately 3 mm and approximately 4 mm (e.g., approximately 3.7 mm), or in a range between approximately 2 mm and approximately 3 mm (e.g., approximately 2.9 mm).

The width of the recess 112 (face-to-rear direction) can vary across the heel-to-toe direction of the club head 100. For example, as illustrated, the width of the recess 112 can have a local width minima at or near the center line of the ball-striking face 101, and the width of the recess can increase along the center-to-heel direction and/or center-to-toe direction. The width of the recess 112 can increase until a certain point is met, such as the end of the middle portion of the recess 112. Alternatively or in addition, the width of the recess 112 can increase until a location is reached in the heel-to-toe direction that matches, or approximately matches, the location at which the grooves on the ball-striking face 112 end. Then, continuing in the center-to-heel direction and/or center-to-toe direction the width can decrease, gradually or otherwise (e.g., until another local width minima is reached). The minimum width of the recess 112 can be at or near the end of the wings of the recess 112.

Figure 9:
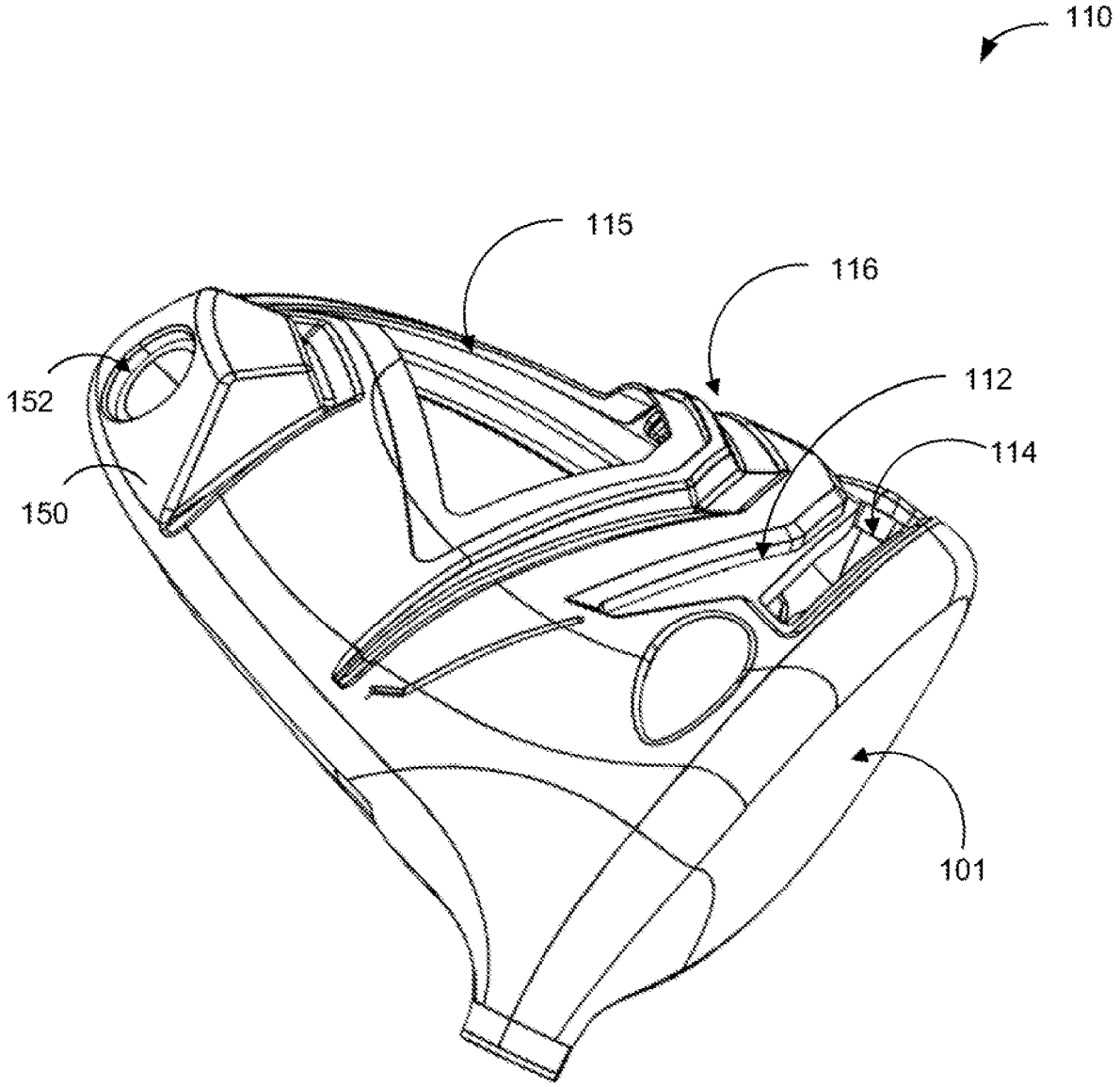
FIG. 9 is a heel-side view of a shell of an example club head, in accordance with the disclosed technology.
Figure 10:
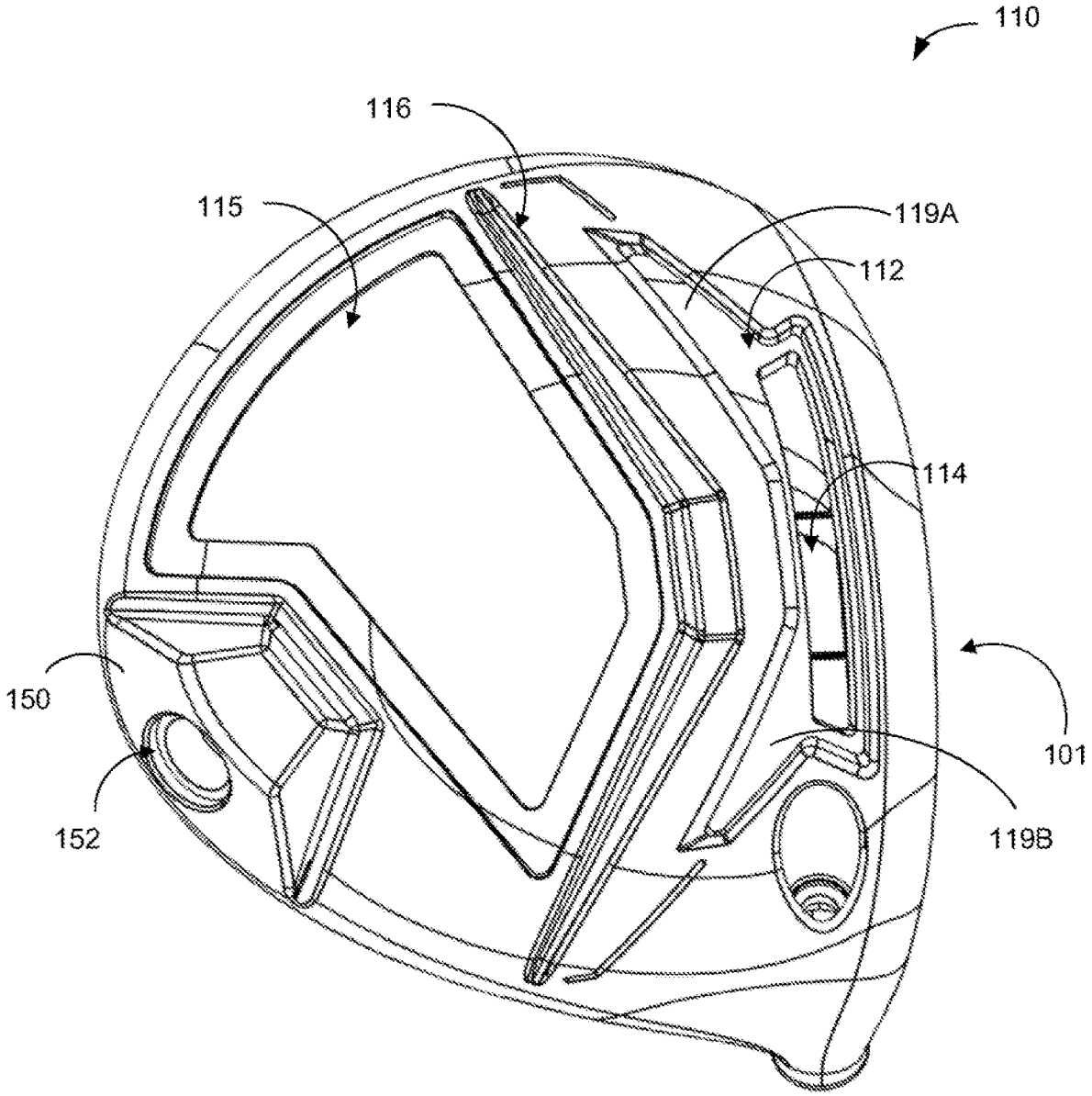
FIG. 10 is a bottom view of a shell of an example club head, in accordance with the disclosed technology.
Figure 19:
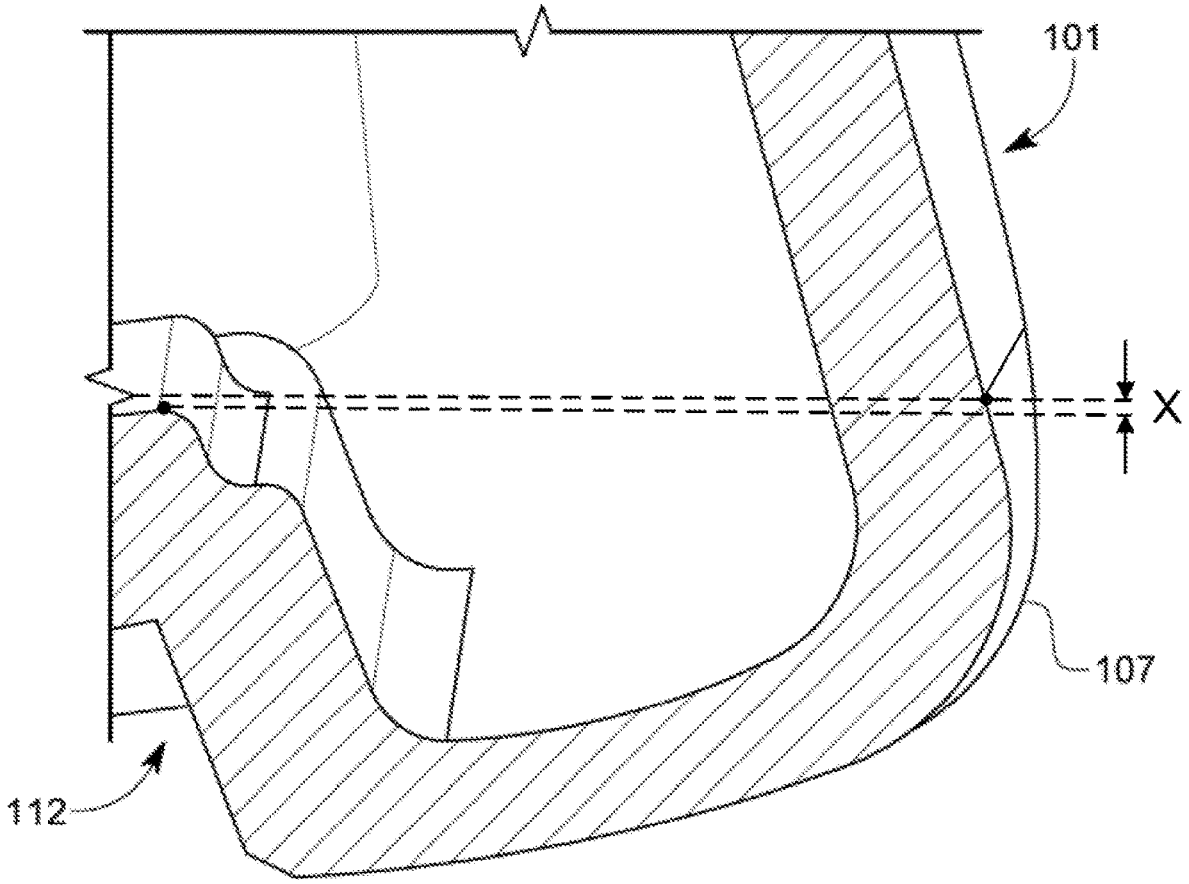
FIG. 19 is a cross-sectional view of an example ball-striking face and an opening formed in an example club head, in accordance with the disclosed technology.

The recess 112 and the opening 114 can each have sidewalls extending inwardly into the inner volume of the club head 110. The recess 112 can have a bottom surface (e.g., as shown in FIGS. 9 and 10) that has a maximum depth that is less than the maximum depth of the sidewalls forming the aperture. Alternatively, the opening 114 omits sidewalls such that the opening 114 is simply a hole in the bottom surface of the recess 112. The bottom surface of the recess 112 can be generally perpendicular to at least a portion of the ball-striking face. Alternatively or in addition, a given location of the bottom surface of the recess 112 can be generally parallel to a corresponding location on the outer surface of the club head (e.g., including the insert 120). That is to say, the insert 120 can have a constant thickness at portions of the insert 120 overlapping the recess 112 but not the opening 114. Alternatively, the insert can have a varying thickness at portions of the insert 120 overlapping the recess 112 but not the opening 114. As shown in FIG. 19, the maximum depth of the sidewalls defining the opening 114 (e.g., relative the ground) can be less than the height of the leading edge 107 of the club head 100 (e.g., also relative the ground) by a distance X. Alternatively or in addition, the maximum depth of the sidewalls can be at a height that is less than the height of the lower edge of the face 101 (e.g., the lower edge of the face 101 being the point at which there is a substantial change in curvature from the main face surface, such as when the main face surface transitions to the sole). Alternatively or in addition, the leading edge 107 shape (e.g., the transition from the main face surface to the sole) can be rounded or substantially rounded, which can result in a taller leading edge height (e.g., as compared to a design in which the leading edge shape is a sharper angle). Further, such a rounded and/or blunted leading edge can help provide better (e.g., smoother) turf interaction and/or less digging of the club head 100 into the ground during impact.

The shell 110 can include a channel 116. The channel 116 can be located rearwardly from the insert 112. When viewed in cross-section, the channel 116 can have an A- or V-shaped shape. That is to say, the channel 116 can include two opposing walls when viewed in cross-section, and the two opposing walls can intersect or otherwise meet (e.g., near the center of the channel 116) to form a point (e.g., peak, valley) or bend. Alternatively, the opposing walls can intersect a third wall extending between the opposing walls. One, some, or all of the walls can extend in a straight line. Alternatively, one, some, or all of the walls can be curved.

The maximum depth of the channel 116 can be approximately equal to the maximum depth of the recess 112. Alternatively, the maximum depth of the channel 116 can be less than the maximum depth of the recess 112. As another alternative, the maximum depth of the channel 116 can be greater than the maximum depth of the recess 112. Alternatively or in addition, the maximum depth of the channel 116 can be greater than the maximum depth of the recess 112 but less than the maximum depth of the sidewalls defining the opening 114. Alternatively or in addition, the maximum depth of the channel 116 can be greater than both the maximum depth of the recess 112 and the maximum depth of the sidewalls defining the opening 114.

From a bottom view (e.g., FIG. 9), the channel 116 can include a middle portion that can be approximately parallel to at least a portion of the ball-striking face 101 (e.g., at or near the center of the ball-striking face 101, at or near the "sweet spot" or ideal contact location of the ball-striking face 101). Alternatively, the middle portion can be offset from the center and/or "sweet spot" of the ball-striking face 101. The channel 116 can include a wing 119A and 119B on either side of the middle portion (as illustrated in FIG. 10). The wings 119A and 119B can be substantially the same such that the channel is symmetrical (e.g., with respect to a plane extending between the sole and the crown and between the ball-striking face 101 and the rear 102) or substantially symmetrical. Alternatively, the wings 119A and 119B can have different sizes and/or shapes such that the channel 116 is asymmetrical. The wings 119A and 119B can extend to the rear and outwardly. That is to say, the heel-side wing 119B can extend from the middle portion in a direction that is at least partially extending toward to the heel end 103 and/or at least partially extending toward the rear 102. Likewise, the toe-side wing 119A can extend from the middle portion in a direction that is at least partially extending toward to the toe end 104 and/or at least partially extending toward the rear 102. The wings 119A and 119B can extend in a straight or substantially straight line. Alternatively, the wings 119A and 119B can curve. One or both of the ends of the channel 116 (e.g., the tips of the wings 119A and 119B at the toe side and/or heel side) can be open-ended. Alternatively or in addition, one or both of the ends of the channel 116 can be recessed relative the neighboring external surface(s) of the club head 100.

The club head 100 can include a sole or insert 130 that is located at least partially on the sole of the club head 100. The sole insert 130 can be located on the sole at a position that is rearward from the channel 116. The sole insert 130 can be made from or comprise a metal (e.g., titanium, aluminum, titanium alloys, aluminum alloys, steels, stainless steels), a composite material (e.g., a fiber-polymer composite, a resin), or any other useful material, depending on the desired mass distribution and/or target performance characteristics of the club head (e.g., fade bias, draw bias). The sole insert 130 can extend across some or all of the sole in the heel-to-toe direction. As illustrated, the sole insert 130 can extend across substantially all of a rear-toe quadrant of the sole. The sole insert 130 can include one or more channels, such as the channel illustrated in FIGS. 3-5, for example. The inclusion or omission of one or more channels, as well as the size and positioning of such channel(s) can impact the mass distribution and/or performance characteristics of the club head.

Figure 5:
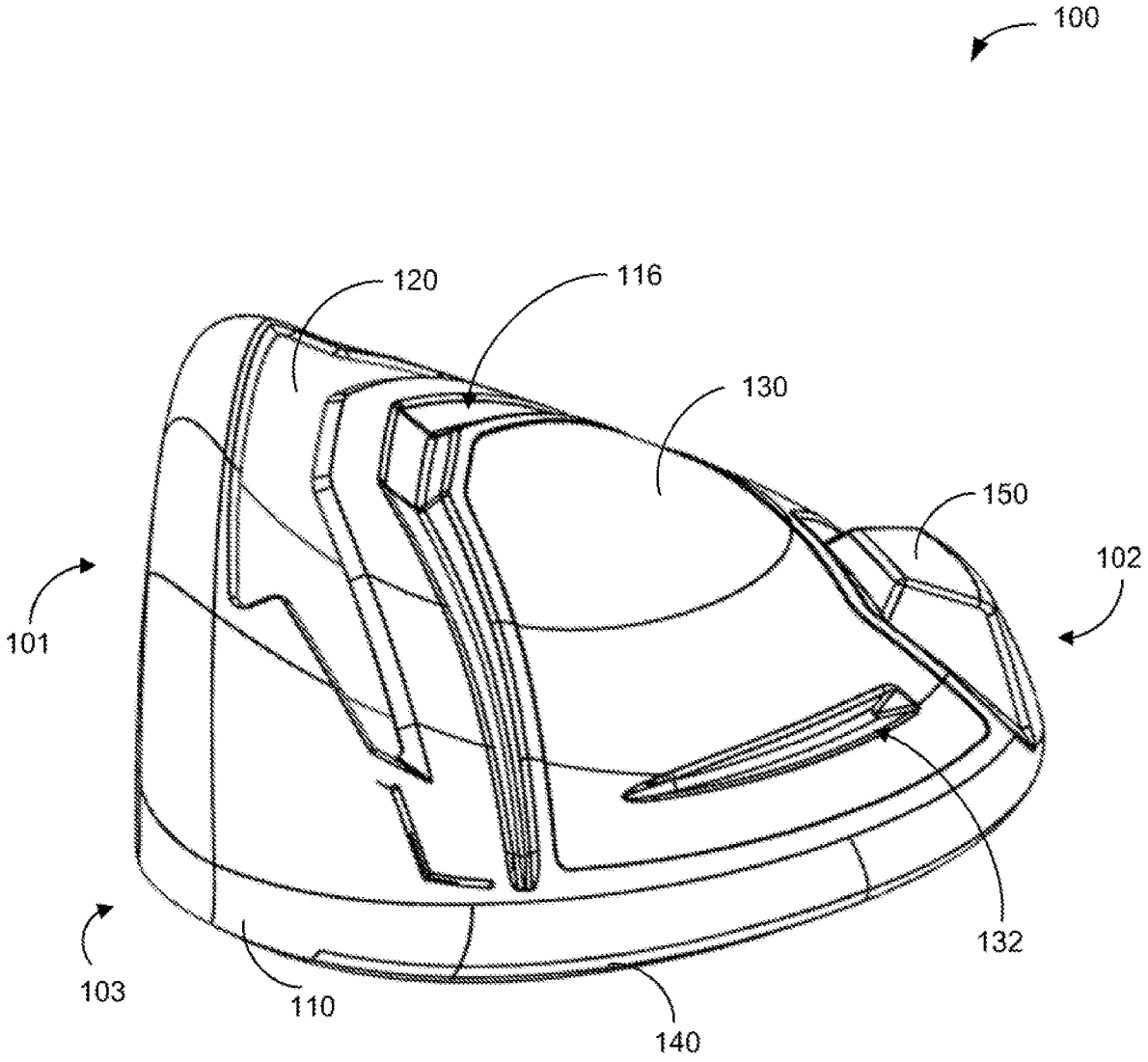
FIG. 5 is a toe-side view of an example club head, in accordance with the disclosed technology.
Figure 6:
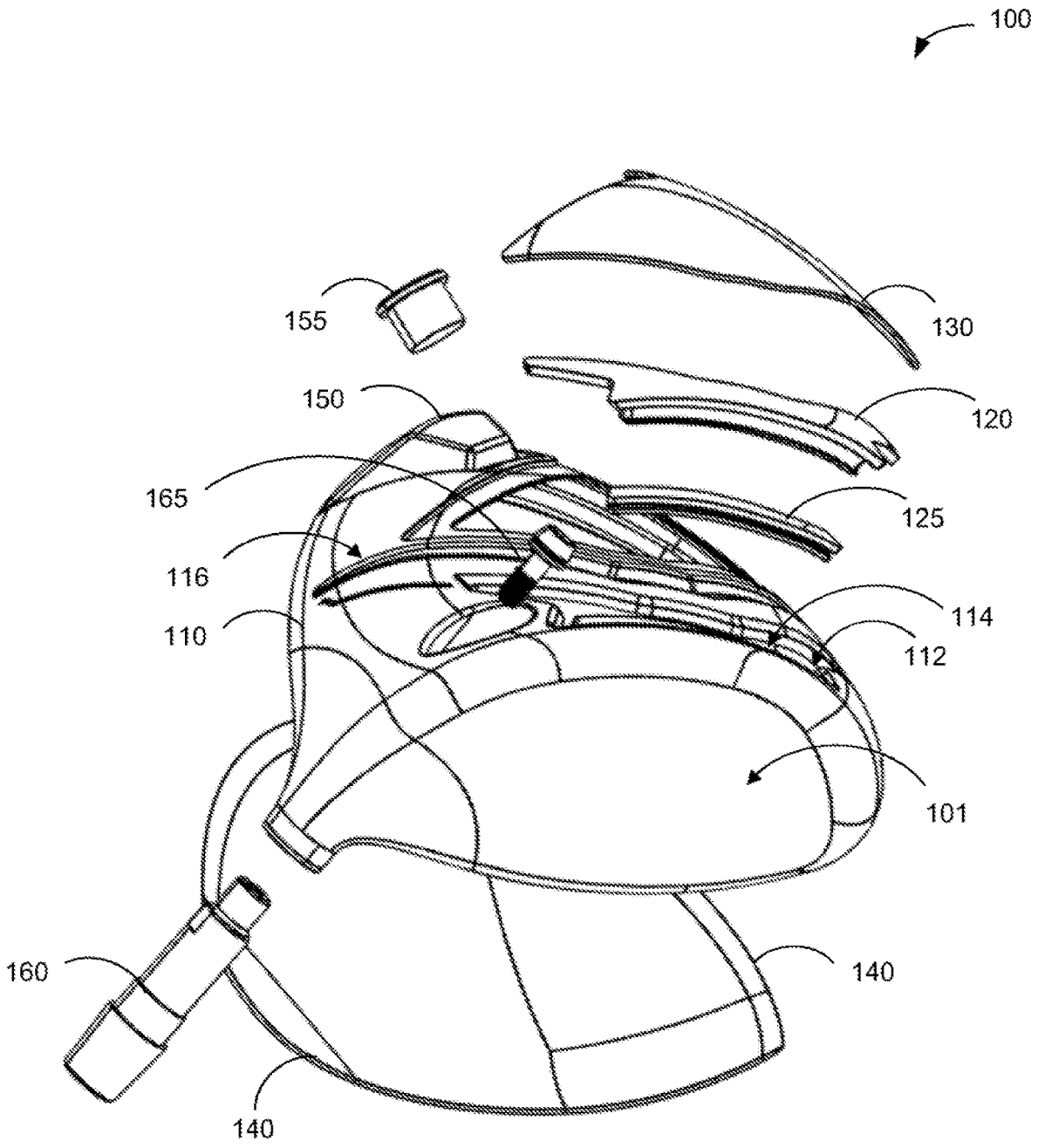
FIG. 6 is an exploded view of an example club head from a general heel-end, face-side perspective, in accordance with the disclosed technology.
Figure 7:
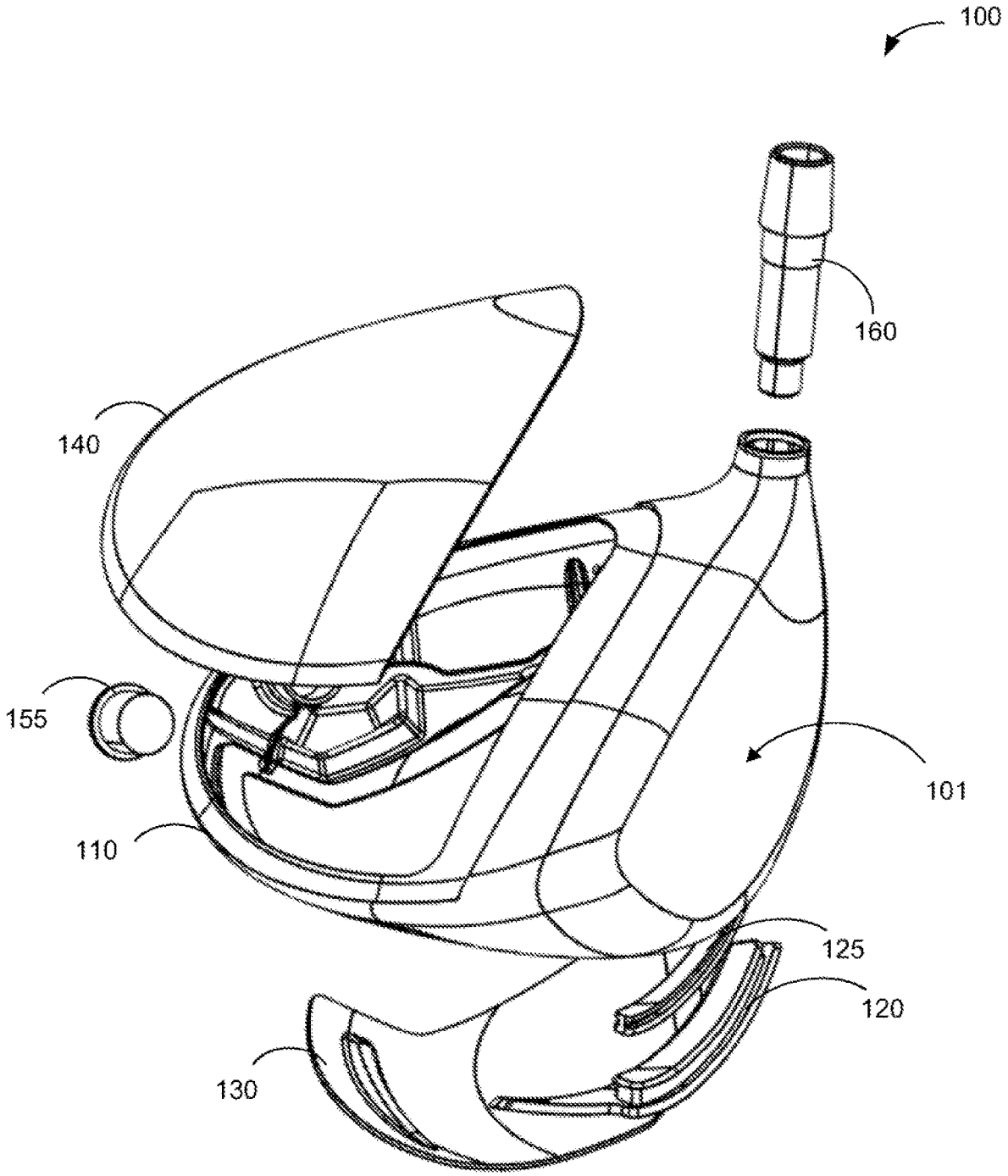
FIG. 7 is an exploded view of an example club head from a general toe-end perspective, in accordance with the disclosed technology.
Figure 8:
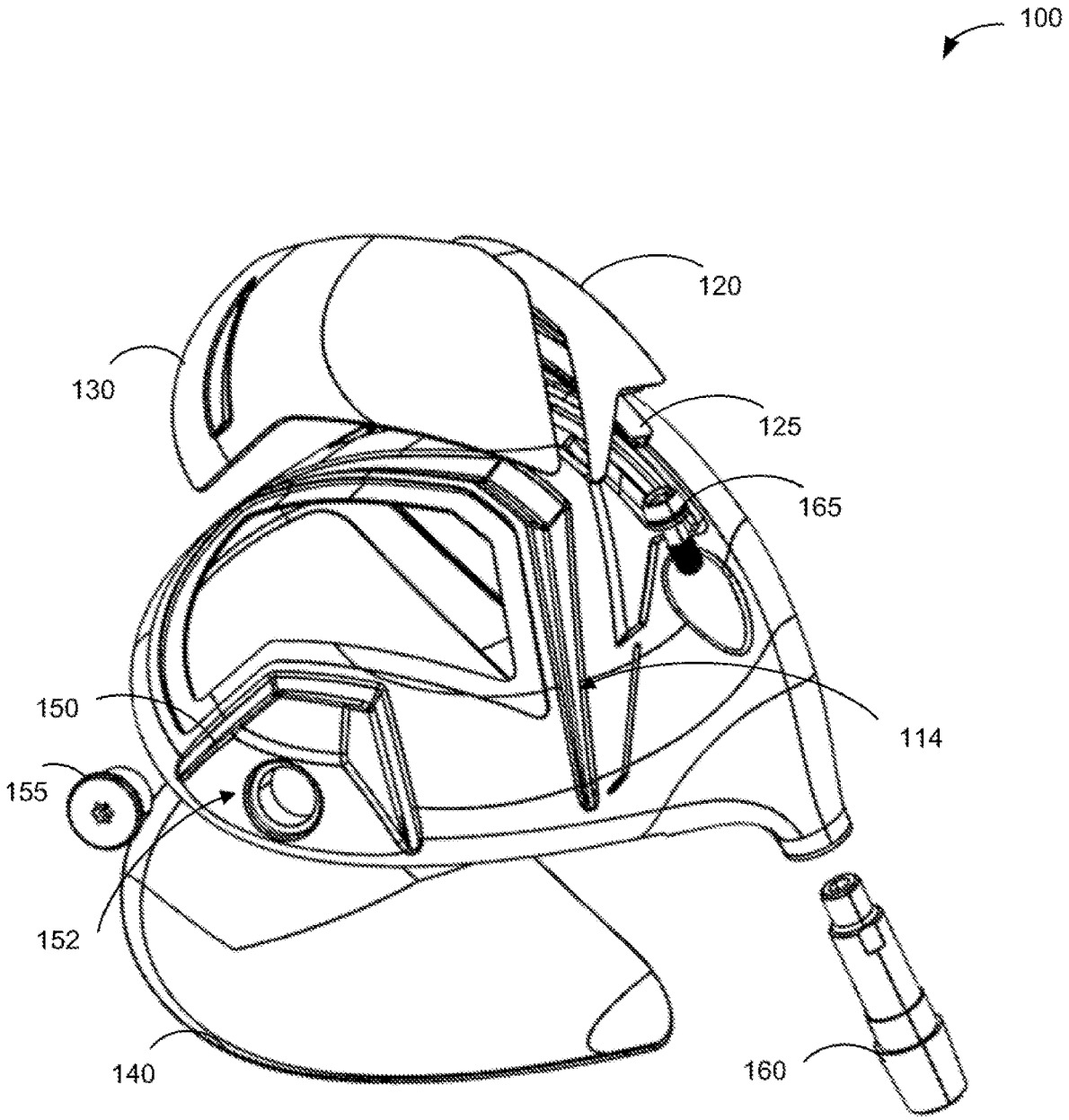
FIG. 8 is an exploded view of an example club head from a general heel-end, rear side perspective, in accordance with the disclosed technology.

The club head 100 can include a protrusion 150 that extends outwardly from the contoured surface of the club head 100 (e.g., shell 110), which may be most recognizable in FIG. 5. The protrusion 150 can be located at or near the rear 102 of the club head 100. As illustrated, the protrusion 150 can be located in a rear-heel quadrant of the sole. The protrusion 150 can extend in a substantially outward direction (e.g., in the sole direction relative a center of the club head 100), but in such cases, the contour of the club head 100 at the rear 102 and the rearward location of the protrusion 150 can be sufficient to prevent the protrusion 150 from digging into the ground or otherwise negatively interacting with the ground during use. The protrusion 150 can extend outwardly from the smooth contour of the club head. Alternatively, as illustrated in FIG. 9, for example, the protrusion 150 can be separate from the general contour of the sole via a trench or channel, which can be shaped similarly to the channel 116. The rear-most edges or walls of this trench or channel can be defined, at least in part, by corresponding side walls of the protrusion 150.

The protrusion 150 can include a weight opening 152 that can be configured to receive a weight 155. The weight 155 can be configured to be permanently affixed within the weight opening 152. Alternatively, the weight 155 can be configured to detachably attach in the weight opening 152. For example, the weight 155 and the weight opening 152 can include threads for screwing the weight into the weight opening 152. As such, the weight 155 can be configured to be removed and replaced with a different weight 155 having a greater or lesser mass, depending on the desired mass distribution and/or performance characteristics.

At least a portion of the weight 155 can have a generally longitudinal shape (e.g., rectangular prism, cylinder) and can be configured to extend inwardly toward the inner volume of the club head 100 when installed. The weight 155 can have the same, or approximately the same mass, as the insert 120. Alternatively, the weight 155 can have less mass than the insert 120. As another alternative, the weight 155 can have more mass than the insert 120.

The club head 100 can include a crown portion or insert 140 that is located at least partially on the crown of the club head 100. The crown insert 140 can be made from or comprise a metal (e.g., titanium, aluminum, titanium alloys, aluminum alloys, steels, stainless steels), a composite material (e.g., a fiber-polymer composite, a resin), or any other useful material, depending on the desired mass distribution and/or target performance characteristics of the club head (e.g., fade bias, draw bias). The crown insert 140 can extend across some or all of the crown in the heel-to-toe direction. The crown insert 140 can extend across substantially all of a rear-toe quadrant of the crown and/or a rear-heel quadrant of the crown. The crown insert 140 can have an exterior that is substantially smooth and contoured, and the crown insert 140 can be configured to interface with the shell 110 such that the exterior surface of the crown insert 140 smoothly transitions to the exterior surface of the shell 110 surrounding the crown insert 140.

The sole insert 130 and/or crown insert 140 can be sized (e.g., surface area and/or thickness) and shaped to achieve a desired mass distribution and/or performance characteristic(s) of the club head 100.

The club head 100 can include a shaft adapter 160. The adapter 160 can be configured to at least partially insert into the hosel 105 of the club head 100, and an adapter screw 165 can be configured to attach the adapter 160 to the club head 100. The club head 100 (e.g., shell 110) can include an access opening on the sole side of the heel, which can provide access for the adapter screw 165 to insert into the club head 100 from the sole or bottom side and screw into the bottom side of the adapter 160 to secure the adapter 160 to the club head 100. The opposite end of the adapter 160 can be configured to receive an end of a shaft and can thusly be configured to attach the shaft to the club head 100.

Referring particularly to FIGS. 11-14, the shell 110 can include a sole opening 115 configured to at least partially receive the sole insert 130 and/or a crown opening 117 configured to at least partially receive the crown insert 140. Some or all of the edges of the sole insert 130 and/or the crown opening 117 can include a recessed step or lip that can be configured to abut and support an inner surface of the sole insert 130 and/or the crown opening 117, respectively.

Figure 11:
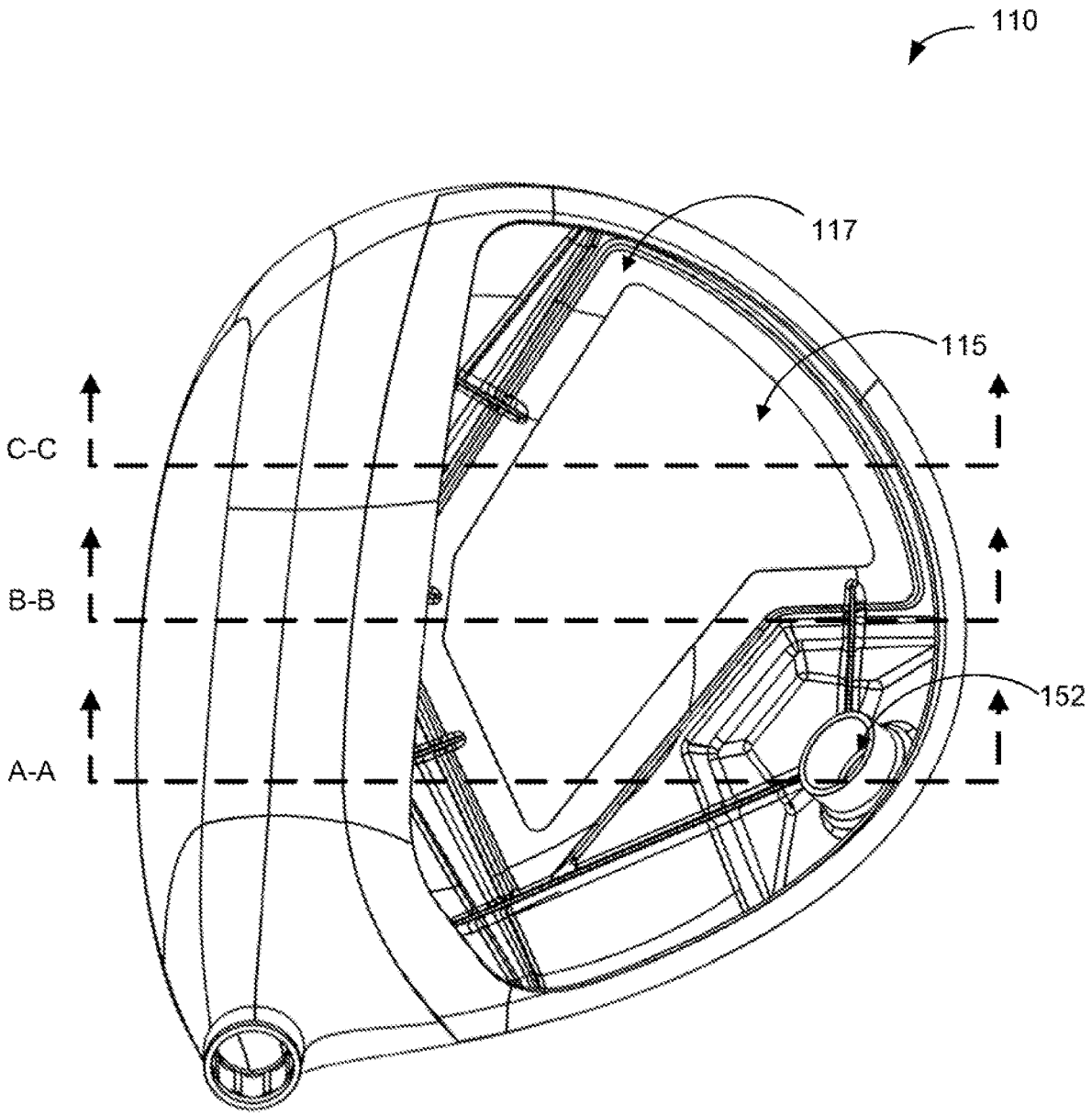
FIG. 11 is a top view of a shell of an example club head, in accordance with the disclosed technology.
Figure 12:
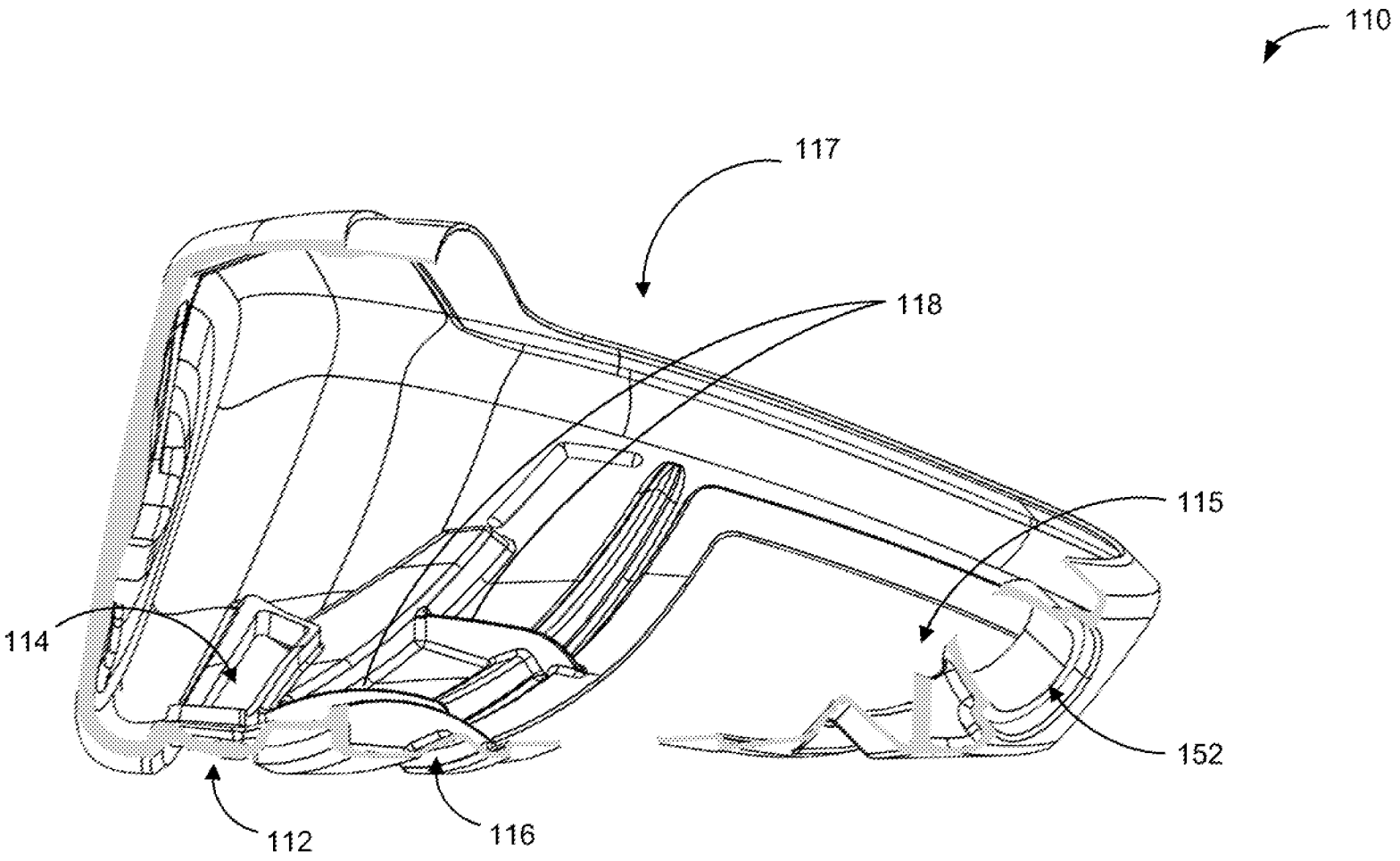
FIG. 12 is a cross-sectional view of a shell of an example club head taken along line A-A in FIG. 11, in accordance with the disclosed technology.
Figure 13:
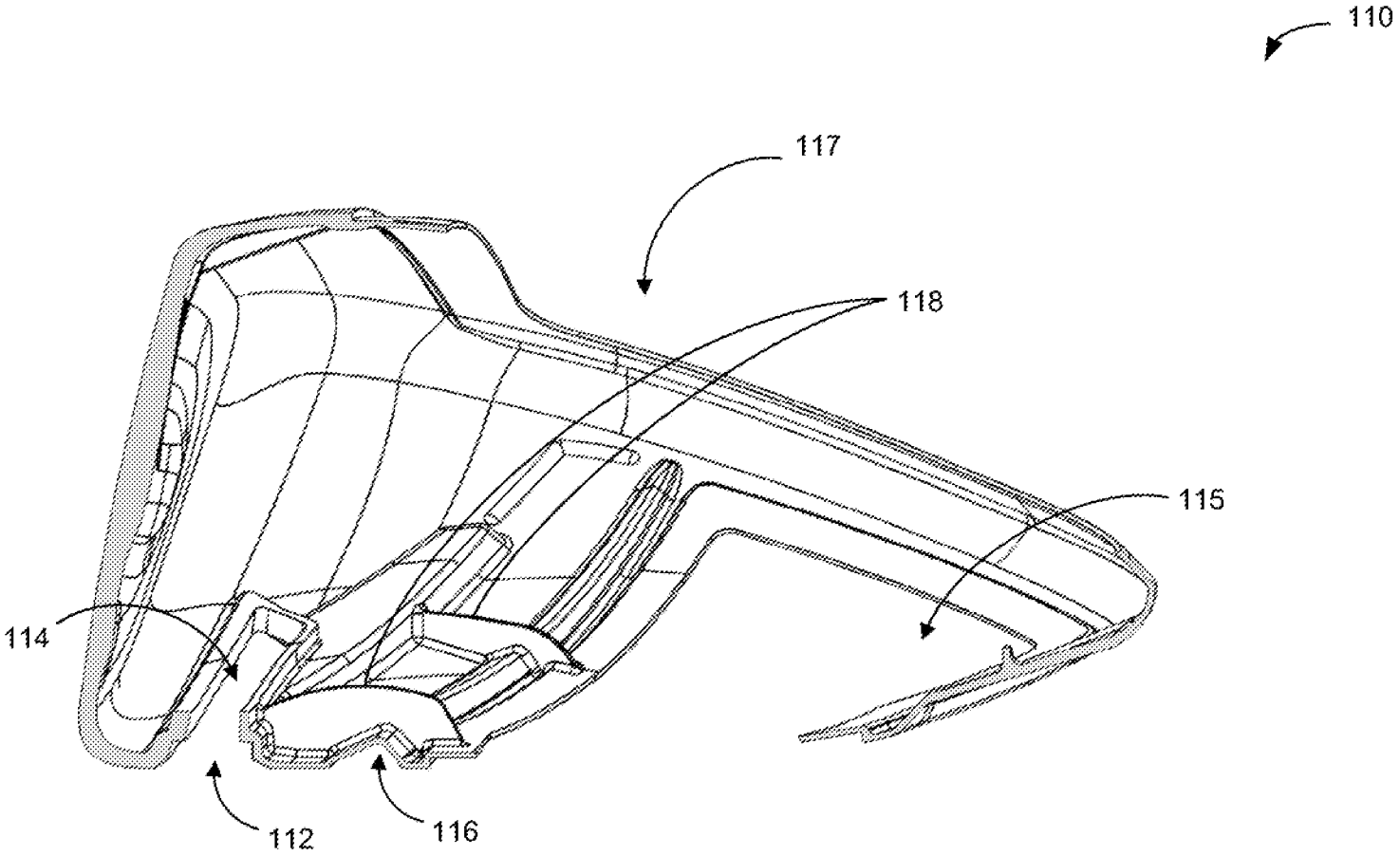
FIG. 13 is a cross-sectional view of a shell of an example club head taken along line B-B in FIG. 11, in accordance with the disclosed technology.
Figure 14:
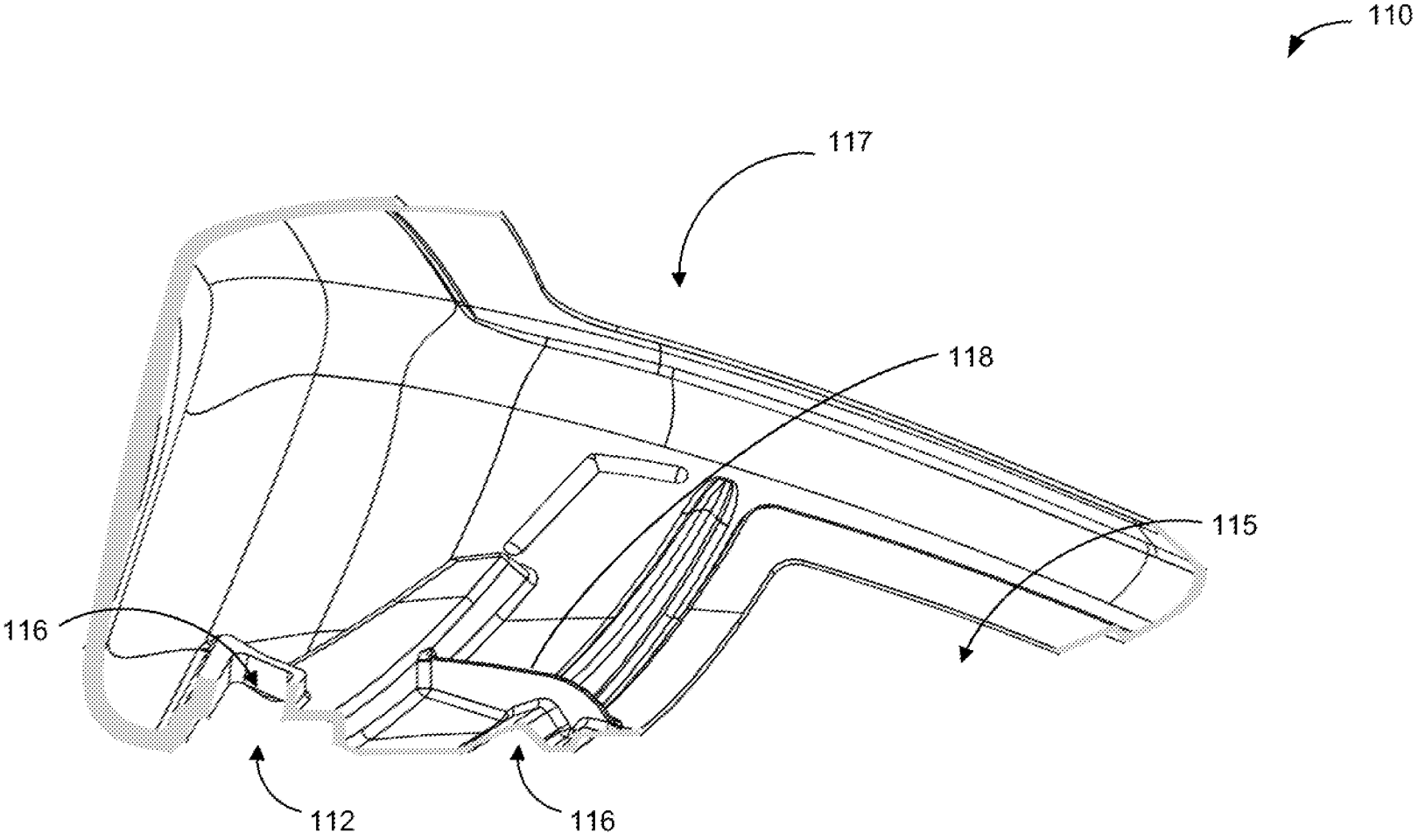
FIG. 14 is a cross-sectional view of a shell of an example club head taken along line C-C in FIG. 11, in accordance with the disclosed technology.

FIGS. 12-14 depict cross-sectional views of the shell 110 taken along lines A-A, B-B, and C-C of FIG. 11, respectively. In each of FIGS. 12-14, corresponding portions of the recess 112, the opening 114, and the channel 116 can be seen. In comparing FIGS. 12-14, it becomes clear that the recess 112, opening 114, and/or channel 116 can have varying widths, varying depths, and/or can curve in a rearwardly direction along the sole. Moreover, the recess 112 (e.g., the trailing edge of the recess) can be connected to the channel 116 (e.g., the leading edge of the channel 116) via one or more trusses 118 (or ribs), which help distribute stress through the club head 110, minimizing the potential for damage and extending the working life of the club head 100.

Figure 15:
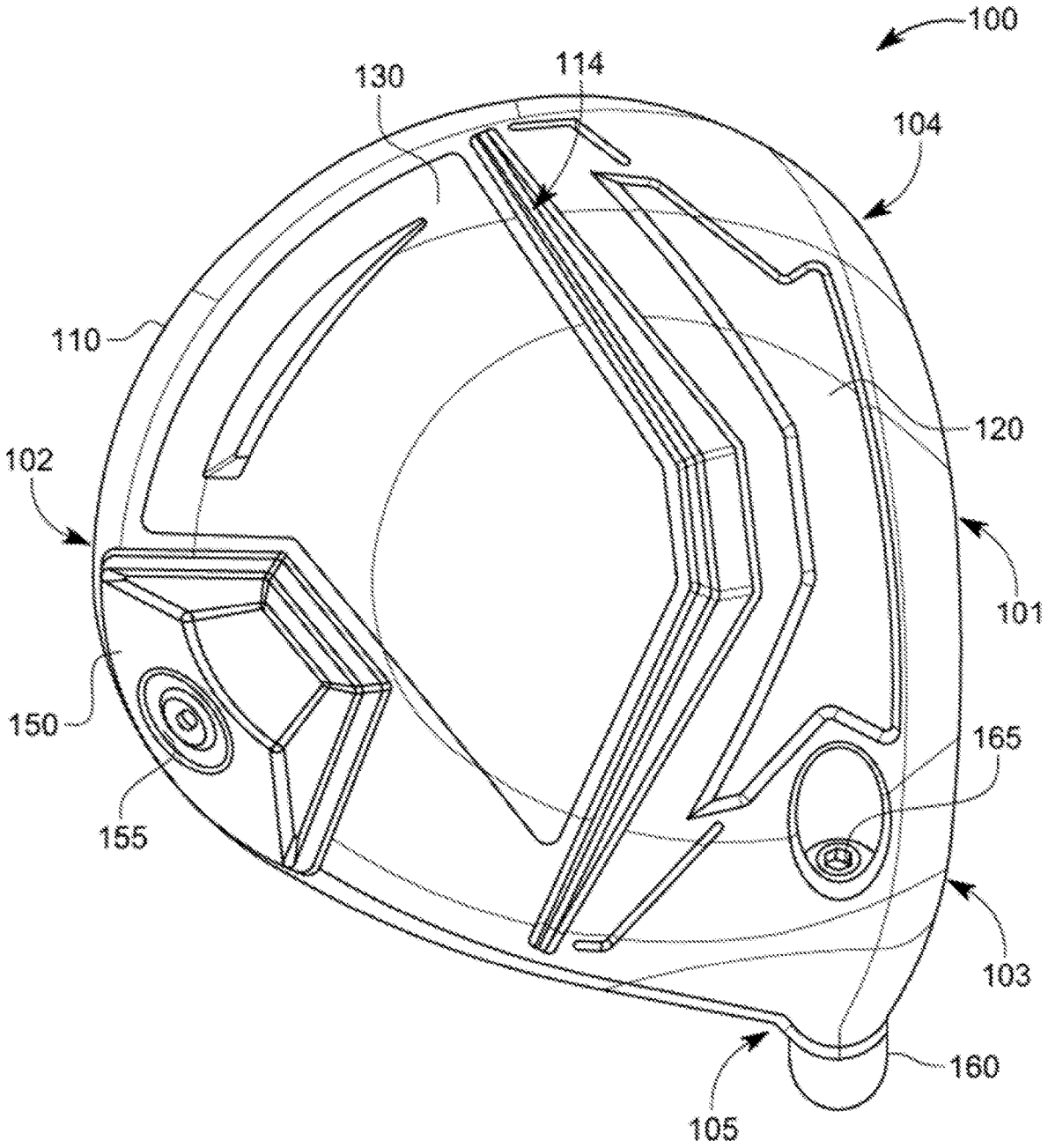
FIG. 15 is a bottom view of an example assembled club head, in accordance with the disclosed technology.
Figure 16:
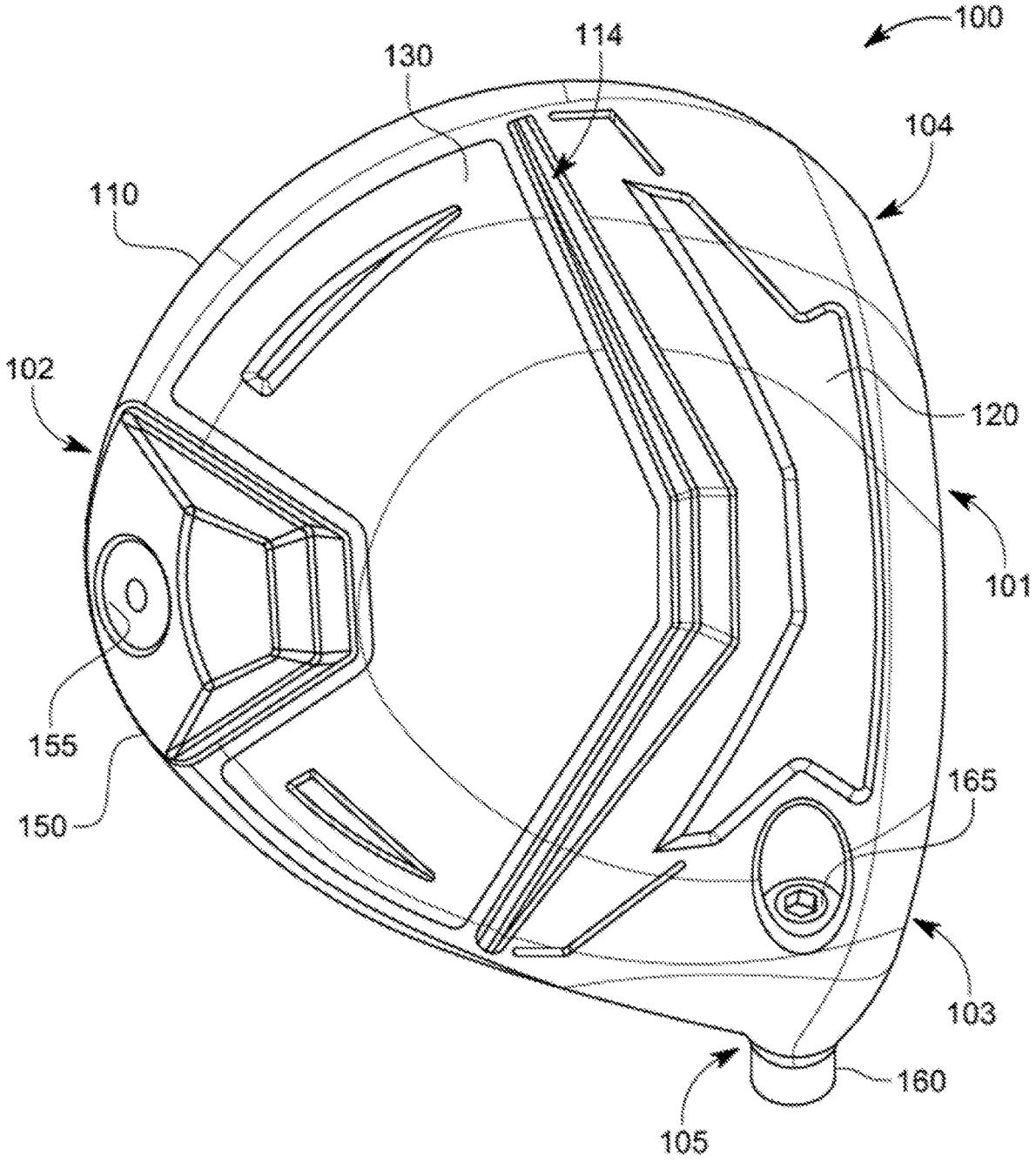
FIG. 16 is a bottom view of an example assembled club head, in accordance with the disclosed technology.

Referring to FIGS. 15 and 16, different configurations are contemplated. For example, the protrusion 150 can be located at least partially (or entirely) in a rear-heel quadrant of the sole (e.g., as in FIG. 15), or the protrusion 150 can be located in a generally central location (e.g., as in FIG. 16), such in a generally central location as along the rear edge of the of the club head 100. Alternatively or in addition, the protrusion 150 can be located at least partially (or entirely) in a rear-toe quadrant of the sole. The club head 100 can include multiple protrusions 150, and these protrusions 150 can be the same or different sizes or shapes. Alternatively or in addition, one protrusion 150 can include a weight opening 152 and weight 155, whereas another protrusion can omit the weight opening 152 and/or weight 155.

Alternatively or in addition, the sole insert 130 can be configured such that a majority (or entirety) of the sole insert 130 is located in a rear-toe quadrant of the sole (e.g., as in FIG. 15). Alternatively, the sole insert 130 can be configured such that approximately half of the sole insert is located in the rear-toe quadrant of the sole and approximately half of the sole insert 130 is located in the rear-heel quadrant of the sole (e.g., as in FIG. 16). Alternatively, the sole insert 130 can be configured such that a majority (or entirety) of the sole insert 130 is located in a rear-heel quadrant of the sole. The crown insert 140 can be configured the same, or substantially the same, as discussed herein with respect to the sole insert 130.

Referring now to FIGS. 17A-17D, the insert 120 can include a middle portion 122 and wings 124, 126. The wings 124, 126 can be on opposing ends of the middle portion 122. The middle portion 122 can have a first shape (e.g., triangular, trapezoidal, square, rectangular), and one or both of the of wings 124, 126 can have a second shape (e.g., triangular, trapezoidal, square, rectangular); the wings 124, 126 can have the same or different shapes. At least a portion of the middle portion can be approximately parallel to at least a portion of the ball-striking face 101 (e.g., at or near the center of the ball-striking face 101, at or near the "sweet spot" or ideal contact location of the ball-striking face 101). Alternatively, the middle portion 122 can be offset from the center and/or "sweet spot" of the ball-striking face 101. The recess 112 can include a wing on either side of the middle portion. The wings 124, 126 can be substantially the same such that the insert 120 is symmetrical (e.g., with respect to a plane extending between the sole and the crown and between the ball-striking face 101 and the rear 102) or substantially symmetrical. Alternatively, the wings 124, 126 can have different sizes and/or shapes such that the insert 120 is asymmetrical. The wings 124, 126 can extend to the rear and outwardly. That is to say, the heel-side wing 124 can extend from the middle portion 122 in a direction that is at least partially extending toward the heel end 103 and/or at least partially extending toward the rear 102. Likewise, the toe-side wing 126 can extend from the middle portion in a direction that is at least partially extending toward the toe end 104 and/or at least partially extending toward the rear 102. The wings 124, 126 can extend in a straight or substantially straight line. Alternatively, the wings 124, 126 can curve. One or both of the ends of the insert 120 (e.g., the tips of the wings 124, 126 at the toe side and/or heel side) can taper to a smaller thickness. Alternatively or in addition, one or both of the ends of the insert 120 can have a substantially constant thickness.

The forward-most portion of a given wing can be offset rearwardly from a nearest forwardmost portion of the middle portion. That is to say, the rearmost portion of the leading edge of the middle portion can be nearer the ball-striking face than the forwardmost portion of one or both wings. Alternatively or in addition, the toe-most and/or heel-most portion(s) of the leading edge of the middle portion can transition directly into the centermost portions of the leading edge of one or both of the wings.

The insert 120 can be configured to be permanently affixed to the club head 100. Alternatively, the insert 120 can be detachably attachable (e.g., via snaps, friction fit, a deformable lip overlapping an edge of the club head 100) such that inserts 120 of different weights can be interchanged to achieve a desired mass distribution and/or performance characteristics.

Regardless, the insert 120 can include a protrusion 128 that is configured to extend inwardly into the opening 114 of the recess 112. The protrusion 128 can have a substantially similar cross-sectional shape and size as the cross-sectional shape of the aperture. The protrusion 128 can include a lip 129 around some or all of the outermost edge of the protrusion 128. The lip 129 can comprise a resiliently deformable material (and/or can comprise the same material as the remainder of the insert body) configured to deform upon insertion into the opening 114. The inner-facing surface of the lip 129 can be chamfered to help facilitate passage of the protrusion 128 and lip 129 through the opening 114. Once the lip 129 has passed the end of the sidewalls of the opening, the lip 129 can return to its original shape and an outer-facing surface of the lip 129 can abut the end of the sidewalls of the opening 114 to retain the insert 120 within the opening 114 and recess 112 and/or attach the insert 120 to the club head 100.

Figure 18:
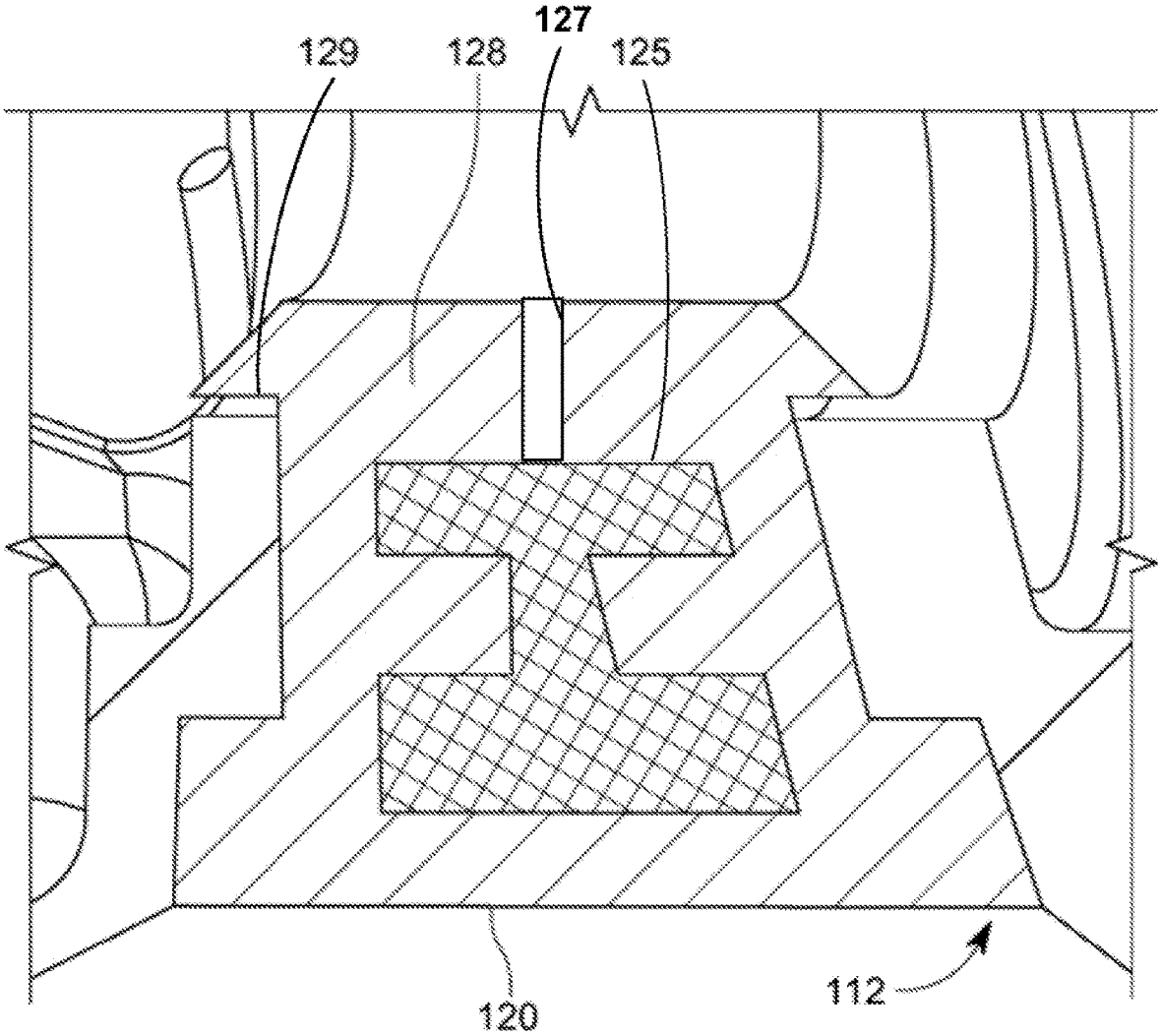
FIG. 18 is a cross-sectional view of an example insert attached to an example club head, in accordance with the disclosed technology.

The insert 120 can include one or more channels 127 extending through an inwardly-facing surface of the insert 120 that can expose the weight 125 to the inner volume of the club head 100. The channels 127 can extend from the inwardly-facing surface of the insert 120 all the way to the weight 125 (as illustrated in FIG. 18). The channels 127, for example, can be formed when the weight is suspended in a mold to form the insert 120 such that the weight 125 is suspended in the insert 120 when formed. Alternatively, or in addition, the pins used to suspend the weight 125 in the mold can remain in the channels 127 after the insert 120 is assembled with the club head 100 such that the pins can extend inwardly into the inner volume of the club head 100.

Figure 17A:
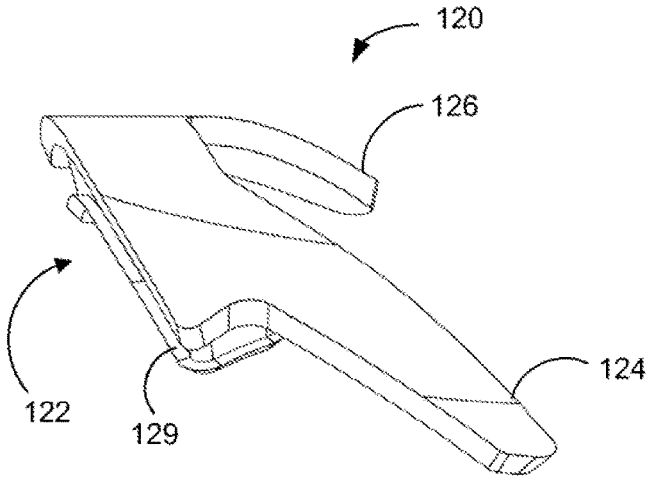
FIG. 17A is a perspective view from an outer-facing side of an example insert, in accordance with the disclosed technology.
Figure 17B:
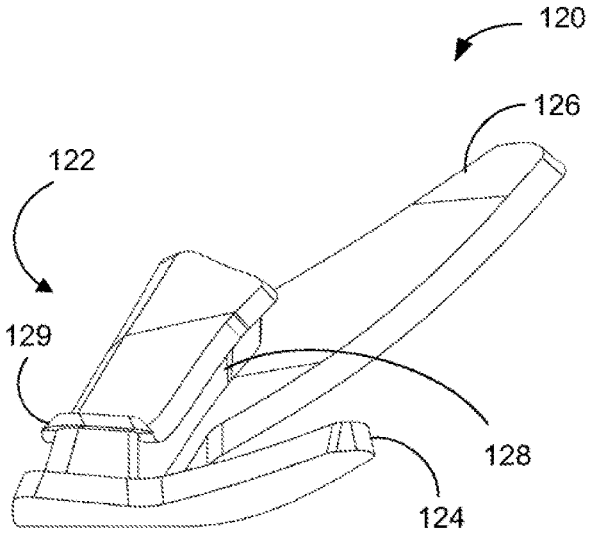
FIG. 17B is a perspective view from an inner-facing side of an example insert, in accordance with the disclosed technology.
Figure 17C:
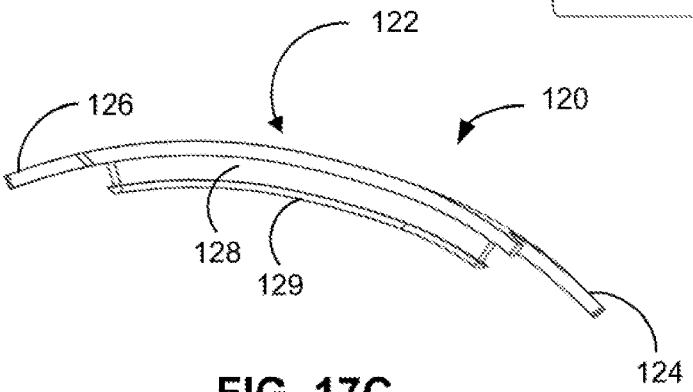
FIG. 17C is a side view of an example insert, in accordance with the disclosed technology.
Figure 17D:
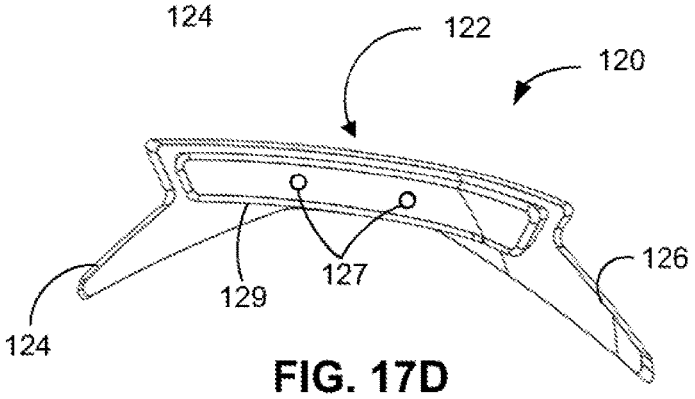
FIG. 17D is a top or inner-facing-side view of an example insert, in accordance with the disclosed technology.
Figure 17E:
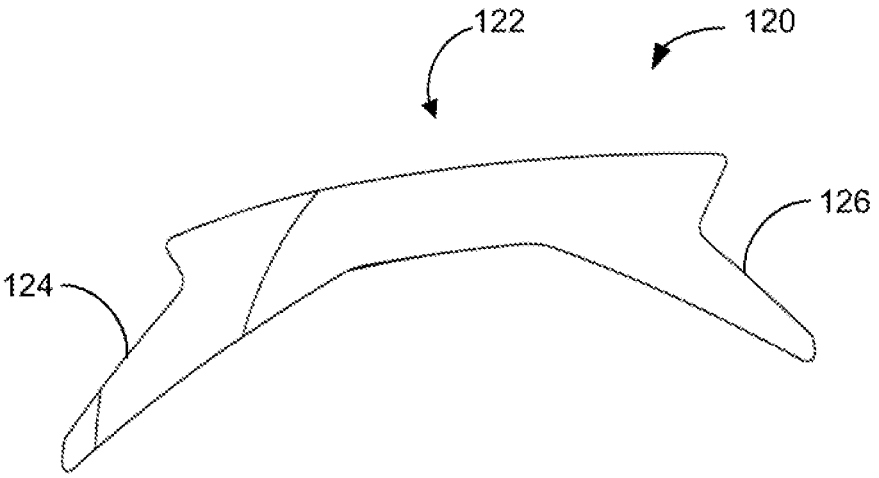
FIG. 17E is a bottom or outer-facing-side view of an example insert comprising a substantially opaque material, in accordance with the disclosed technology.
Figure 17F:
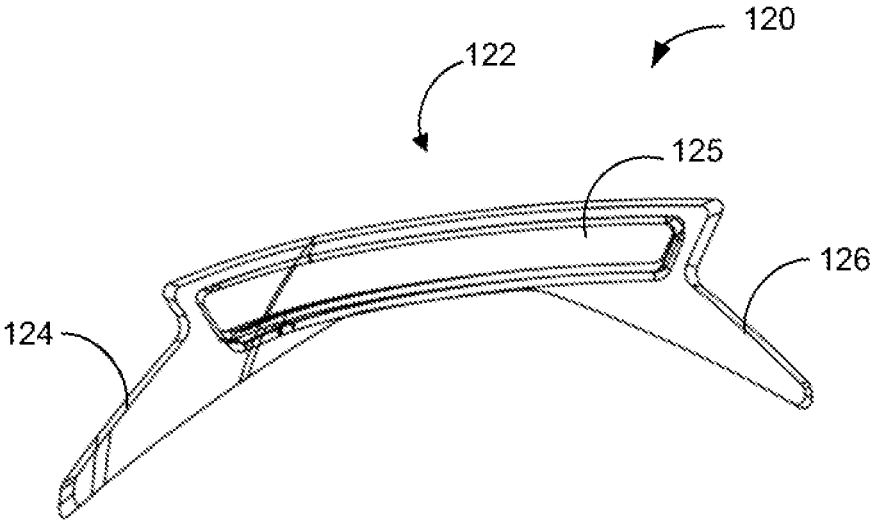
FIG. 17F is a bottom or outer-facing-side view of an example insert comprising a substantially translucent or substantially transparent material, in accordance with the disclosed technology.

As mentioned previously, the insert 120 can comprise a substantially opaque material (e.g., as shown in FIG. 17C) or a substantially translucent or substantially transparent material (e.g., as shown in FIG. 17F). The substantially transparent or translucent material (e.g., thermoplastic polyurethane) can enable visibility of internal components, such as the insert weight 125. The insert can further comprise a UV resistant additive or coloring (e.g., blue) to prevent undesirable yellowing or other unattractive color changes of the insert 120.

The technology and designs presented herein provide many advantages over prior art golf club head designs. These advantages include, but are not limited to, increased performance, reduced vibration, and durability. Moreover, the comparatively high density of the weighted insert 120 and/or the placement of the insert 120 at a location that is low (e.g., at or near the sole) and forward (e.g., near the ball-striking face) and would otherwise include a lower density elastomeric material or air, can efficiently lower the position of the sweet spot on the face of the club head, thereby lowering back spin of a struck golf ball and/or otherwise increasing performance of the club head 100. As an example relating to increased performance, the club head 100 (e.g., the insert 120, the club head 100 and/or shell 110 at or near the recess 112 and/or opening 114) can be configured to more readily flex and/or compress by the stresses induced upon impact of the golf club head with a ball, as compared to existing club head designs. This increased flexibility and/or compressibility can allow an increased energy return (e.g., as compared to a similar club with a conventional slot having toe and heel end walls) as the ball leaves the face. Stated otherwise, the disclosed technology can increase the coefficient of restitution of the club head. Moreover, the distribution of mass afforded by the weighted insert and/or other sole features disclosed herein can reduce the resulting spin imparted to a ball (e.g., by distributing mass within the club head such that the center of gravity is near the sole and ball-striking face), which can provide improved ball flight and/or trajectory.

Further, the various features of the sole disclosed herein can increase the durability and useful life of golf club heads. For example, the insert 120 and/or trusses 118 can distribute stresses incurred at impact over a larger area of the golf club head. This can minimize the likelihood of stress concentration at any given point of the golf club head, which can in turn minimize the likelihood of the golf club head fracturing or otherwise becoming damaged.

It should be appreciated that various designs consistent with the disclosed technology are herein contemplated. For example, referring to the FIGS. 20A-20E, the recess 112 and/or insert 120 can have a shape generally omitting the previously discussed wings 124, 126. As a specific example, the shape of the recess 112 and/or insert 120 can extend to an outer-most point (e.g., on heel side) that is at or near the forward-most edge of the recess 112 and/or insert 120. Alternatively or in addition, the shape of the recess 112 and/or insert 120 can extend to an outer-most point (e.g., on the toe side) that is at or near the middle (in the front-to-rear direction) of the recess 112 and/or insert. Alternatively or in addition, the shape of the recess 112 and/or insert 120 can extend to an outer-most point that is at or near the rear-most edge of the recess 112 and/or insert 120.

Figure 20A:
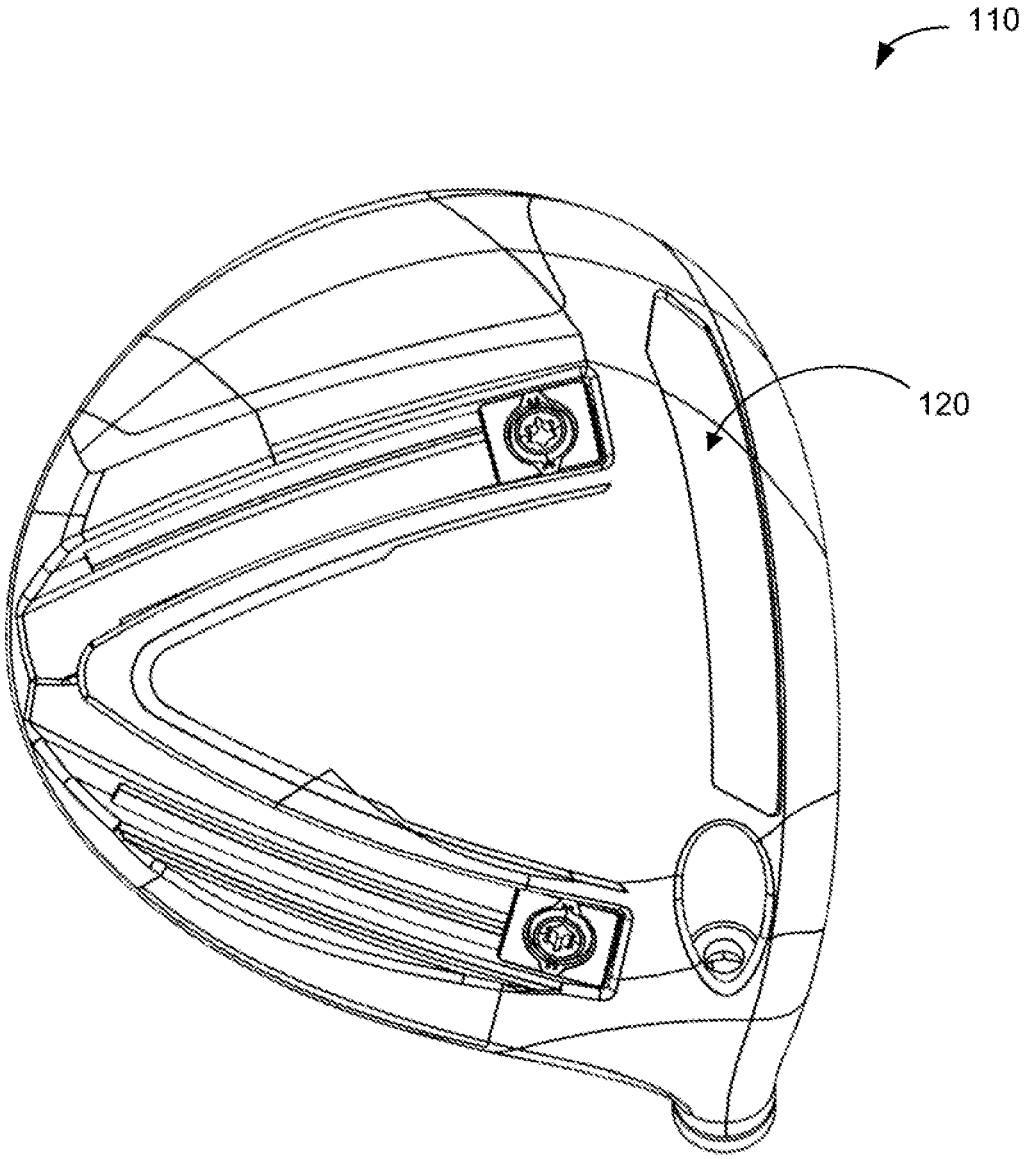
FIGS. 20A and 20B are bottom views of a shell of an example club head, in accordance with the disclosed technology.
Figure 20B:
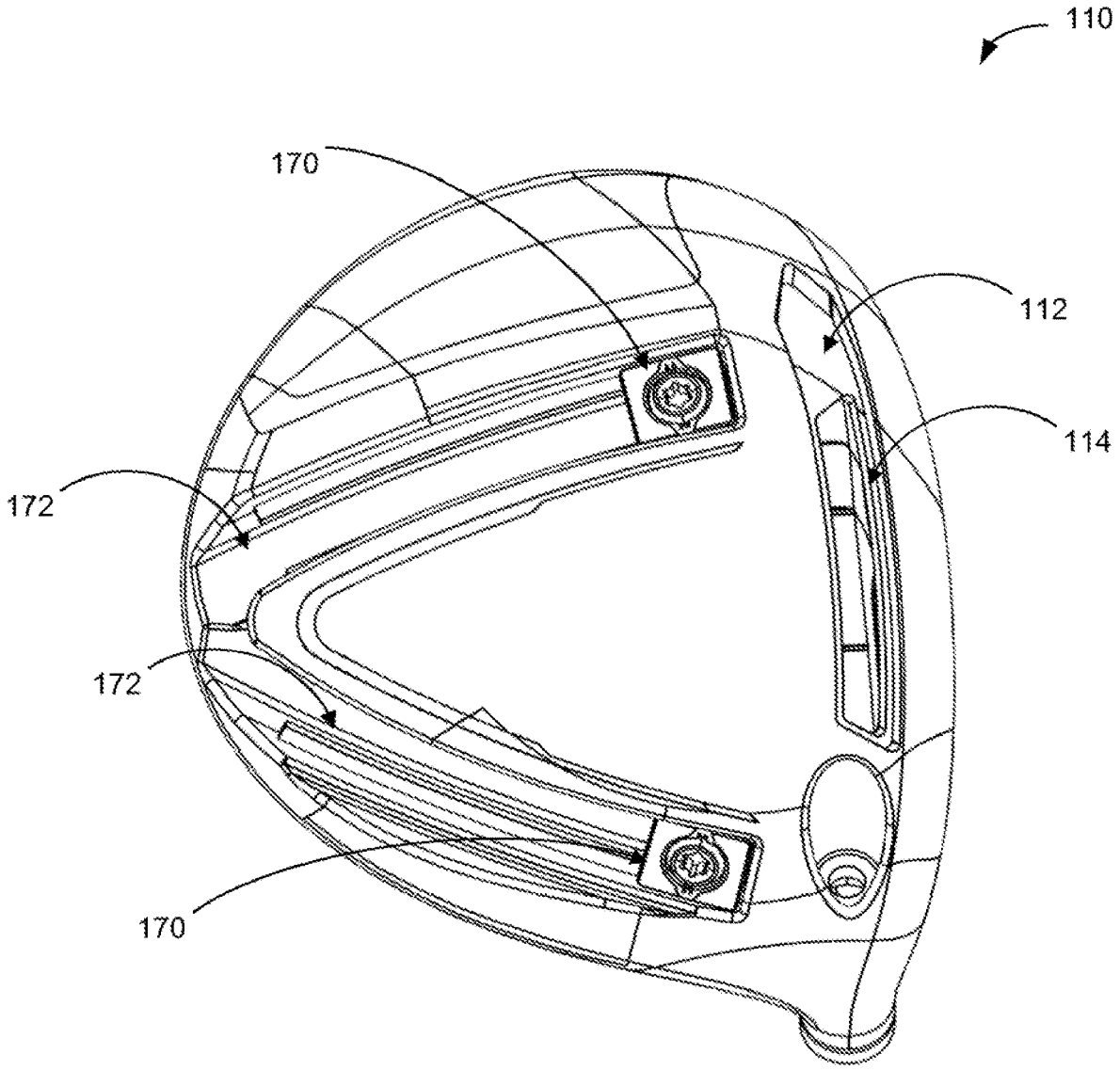
Figure 20C:
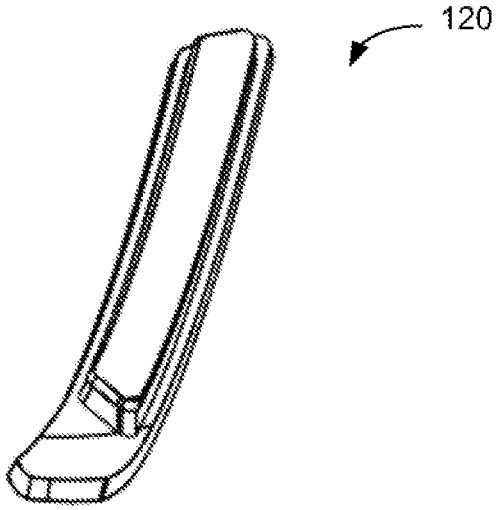
FIG. 20C is a top perspective view of an example insert, in accordance with the disclosed technology.
Figure 20D:
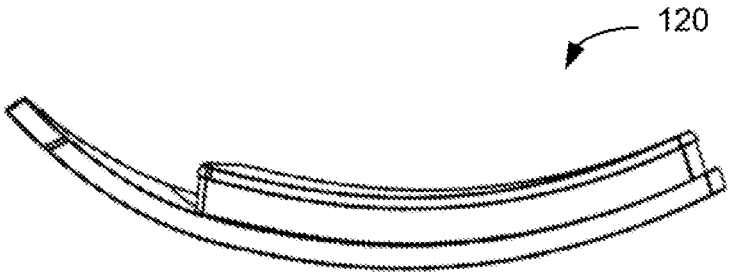
FIG. 20D is a side view of an example insert, in accordance with the disclosed technology.
Figure 20E:
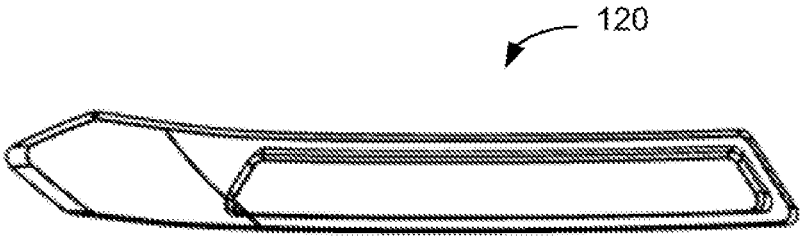
FIG. 20E is a top view of an example insert, in accordance with the disclosed technology.

Alternatively or in addition, the length of the opening 114 can be offset with respect to the length of the recess 112, such as is shown in FIG. 20B, for example. While the opening 114 is shown as being offset in favor of the heel direction, the opening can alternatively be offset in favor of the toe direction. Alternatively, the opening 114 can be centrally located in the toe-to-heel direction within the recess 114.

Likewise, the width of the opening 114 can be offset with respect to the width of the recess 112. For example, the opening 114 can be offset in favor of the forward direction or in favor of the rear direction. Alternatively, the opening 114 can be centrally located in the front-to-rear direction within the recess 114.

Moreover, the disclosed technology includes golf club heads including some of the elements disclosed herein while omitting others. For example, the protrusion 150 can be omitted. Alternatively or in addition, one or more slideable weights 170 can be placed in one or more corresponding tracks 172, which can be located on the sole of the club head 100. The one or more tracks 172 can form a general V-shape extending from a rearmost point and extending to the forward-toe and forward-heel directions such that the V-shape opens toward the ball-striking face.

Figure 21A:
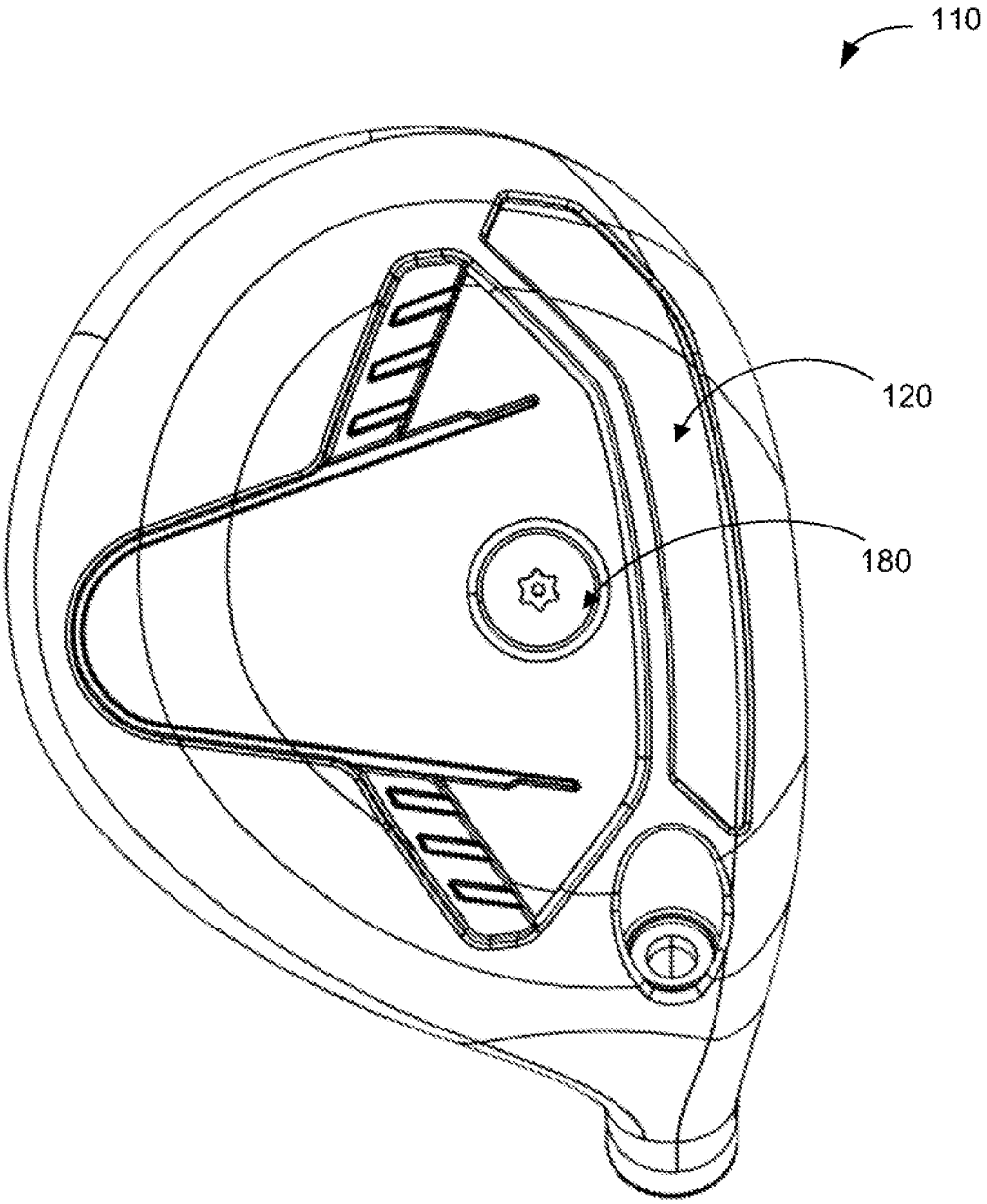
FIGS. 21A and 21B are bottom views of a shell of an example club head having another weight, in accordance with the disclosed technology.
Figure 21B:
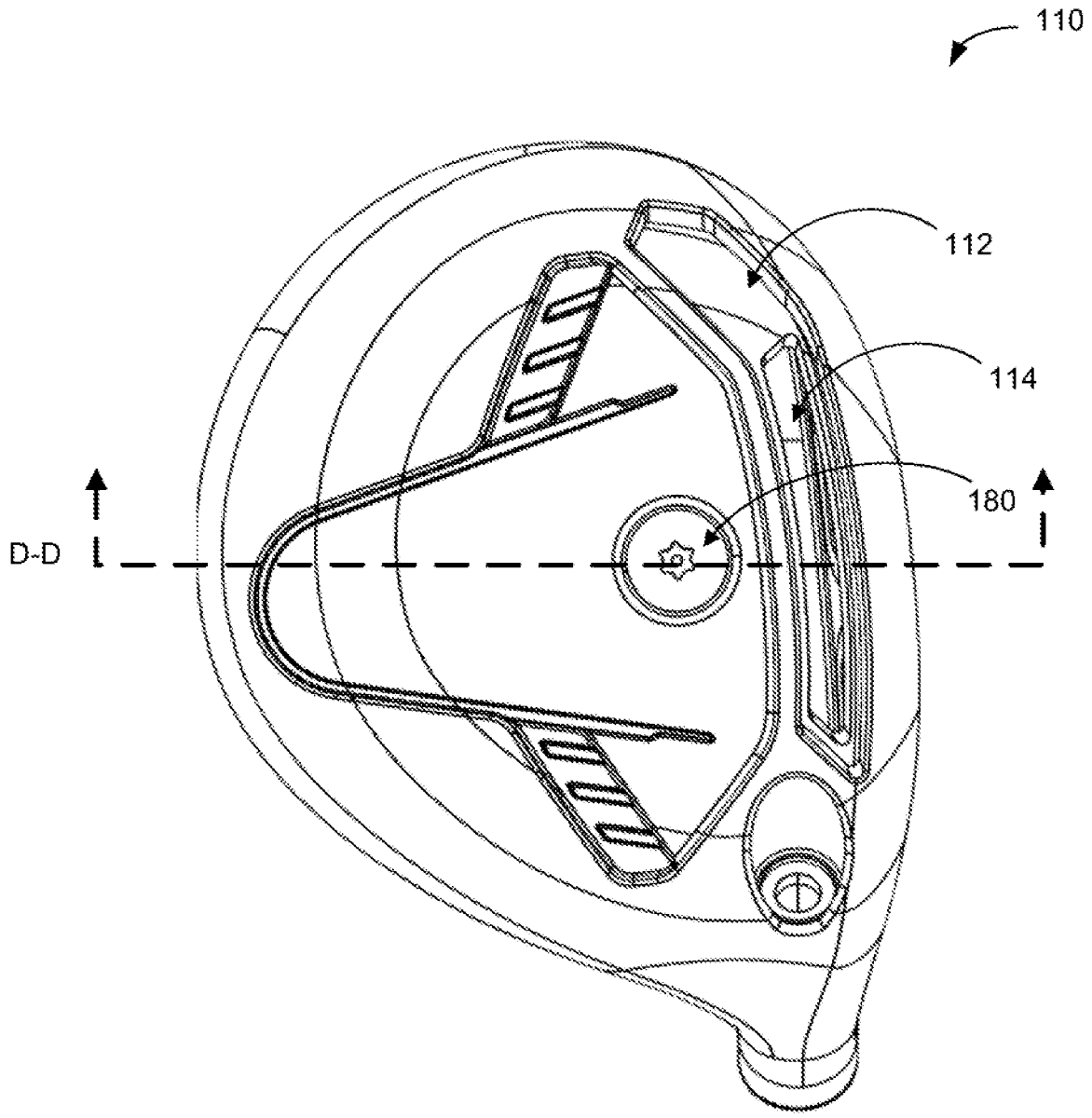

Alternatively or in addition, the recess 112 and/or insert 120 (and/or opening 114) can include a bend, as shown in FIG. 21A, for example. Alternatively or in addition, the width of the recess 112, insert 120, and/or opening 114 can change along the length of the recess 112, insert 120, and/or opening 114, and/or the length of the recess 112, insert 120, and/or opening 114 can change along the width of the recess 112, insert 120, and/or opening 114.

Figure 21C:
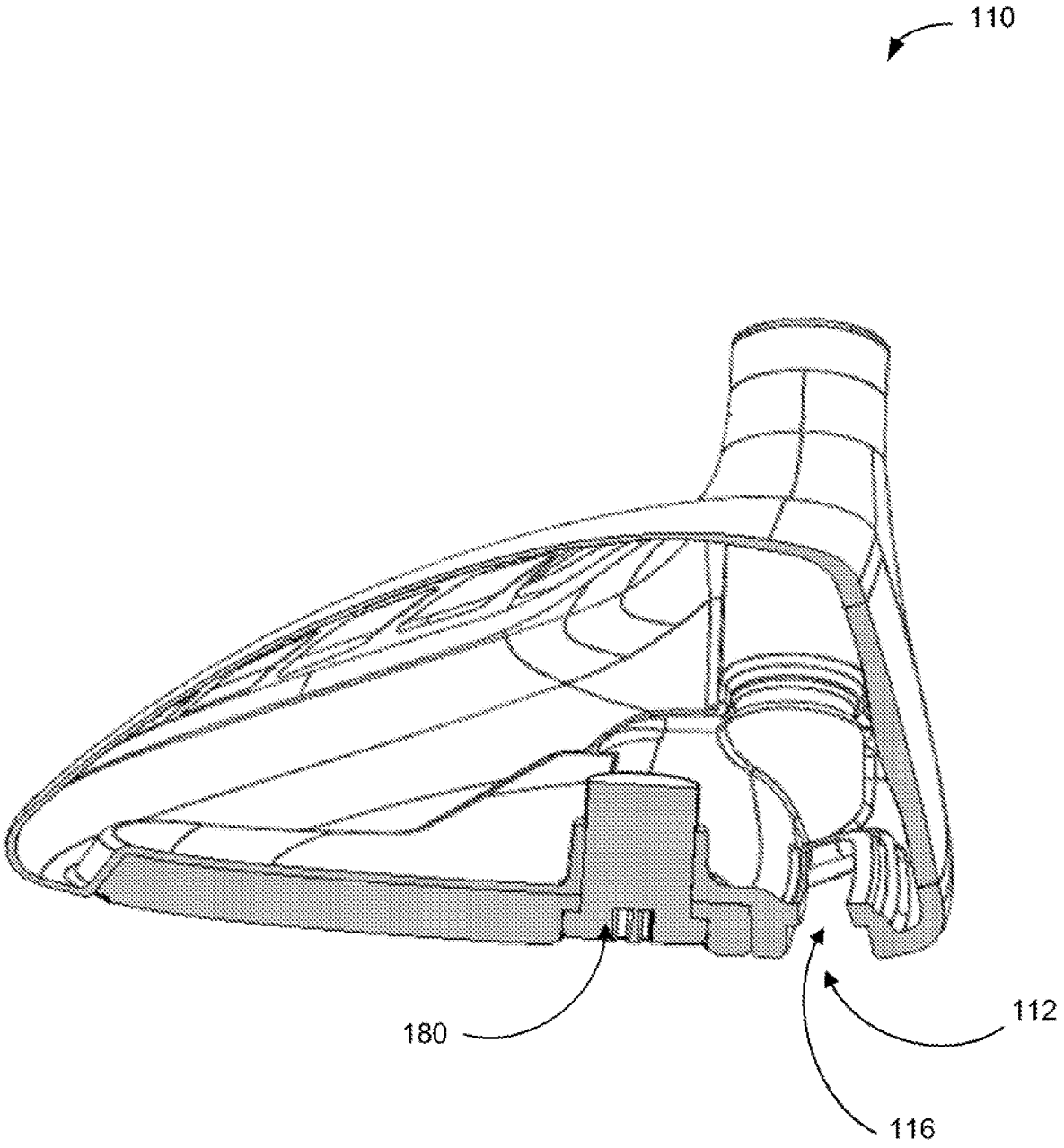
FIG. 21C is a cross-sectional view of an example shell of an example club head having another weight taken along line D-D of FIG. 21B, in accordance with the disclosed technology.
Figure 21D:
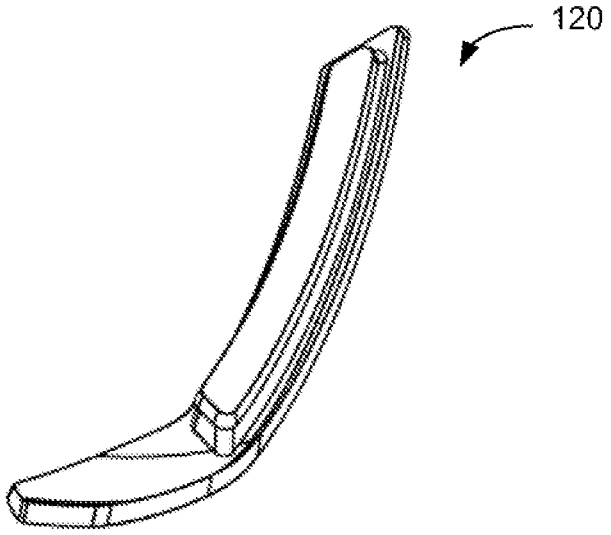
FIG. 21D is a top perspective view of an example insert, in accordance with the disclosed technology.
Figure 21E:
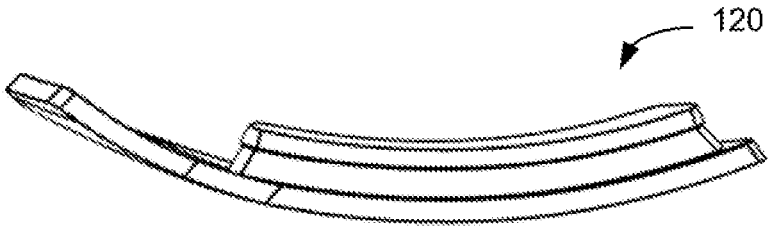
FIG. 21E is a side view of an example insert, in accordance with the disclosed technology.
Figure 21F:
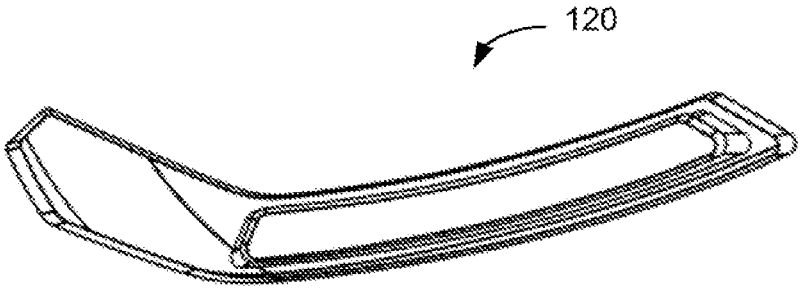
FIG. 21F is a top view of an example insert, in accordance with the disclosed technology.

Alternatively or in addition, as shown in FIG. 21C, the club head can include a separate weight 180 located at a generally central location in the heel-to-toe direction and at a location rearward from the recess 112.

While several embodiments according to the present disclosure have been described, it will be understood that those skilled in the art, both now and in the future, may make various improvements and enhancements that fall within the scope of the following claims.

What is claimed is:

1. A golf club head comprising:

a hollow body comprising a shell defining at least some of an exterior surface of the golf club head, the hollow body including a ball-striking face, a crown, a hosel, a sole, and a rear end opposite the ball-striking face;

a recess located on the sole, the recess extending inwardly toward an interior of the hollow body from the sole to an inner end of the recess;

an opening located within the recess and extending inwardly from the inner end toward the interior of the hollow body, the opening being defined by one or more sidewalls; and a weighted insert configured to insert into the recess and the opening, the weighted insert comprising:

an insert body having a first end, a second end, and a middle portion disposed between the first end and the second end, the first end extending outwardly from the middle portion in a toe-to-heel direction and the second end extending outwardly from the middle portion in a heel-to-toe direction;

a protrusion extending from an inner-facing surface of the insert body and extending at least partially into the opening; and a weight disposed at least partially within the insert body and the protrusion.

2. The golf club head of claim 1, wherein:

the weighted insert further comprises:

a first wing extending outwardly from the first end in a direction that extends at least partially in a toe-to-heel direction and at least partially in a front-to-rear direction; and a second wing extending outwardly from the second end in a direction that extends at least partially in a heel-to-toe direction and at least partially in the front-to-rear direction, wherein at least one of the first and second wings has a first width at a proximal end relative the middle portion and a second width at a distal end relative the middle portion, the first and second widths being measured in the front-to-rear direction.

3. The golf club head of claim 2, wherein the at least one of the first and second wings tapers from the first width to the second width.

4. The golf club head of claim 2, wherein:

the first wing has the first width and the second width, the proximal end is a first proximal end, the distal end is a first distal end, the second wing has a third width at a second proximal end relative the middle portion and a fourth width at a second distal end relative the middle portion, the third and fourth widths being measured in the front-to-rear direction, and the third width is different from the first width.

5. The golf club head of claim 2, wherein:

the first wing has the first width and the second width, the proximal end is a first proximal end, the distal end is a first distal end, the second wing has a third width at a second proximal end relative the middle portion and a fourth width at a second distal end relative the middle portion, the third and fourth widths being measured in the front-to-rear direction, and the fourth width is different from the second width.

6. The golf club head of claim 1, wherein the recess has a cross-sectional shape that is the same as the cross-sectional shape of the weighted insert such that one or more exterior surfaces of the weighted insert contact one or more walls of the recess.

7. The golf club head of claim 1, wherein a rearmost portion of a leading edge of the middle portion of the weighted insert is nearer the ball-striking face than a forwardmost portion of one of the first and second end.

8. The golf club head of claim 7, wherein the rearmost portion of the leading edge of the middle portion of the weighted insert is nearer the ball-striking face than the forwardmost portion of both the first and second ends.

9. The golf club head of claim 1, wherein the weighted insert is symmetrical along a plane extending in a sole-to-crown direction and a front-to-rear direction.

10. The golf club head of claim 1, wherein a minimum width of the middle portion of the weighted insert is located near a midpoint of the middle portion.

11. The golf club head of claim 1, wherein a minimum width of the middle portion of the weighted insert is located at a centerline of the ball-striking face.

12. The golf club head of claim 1, wherein the protrusion of the weighted insert comprises a lip configured to abut one or more surfaces of a sidewall of the opening to thereby retain the weighted insert within the opening.

13. The golf club head of claim 12, wherein the protrusion of the weighted insert comprises a resiliently deformable material.

14. The golf club head of claim 1, wherein the shell comprises a unitary piece forming at least (i) a perimeter of the ball-striking face, (ii) the hosel, and (iii) a skirt positioned between the crown and sole and extending around a rear perimeter portion of the hollow body that extends between a front-heel portion of the hollow body and a front-toe portion of the hollow body, the rear perimeter portion comprising the rear end of the hollow body.

15. The golf club head of claim 14, wherein:

the shell further comprises a sole opening and a crown opening, and the golf club head further comprises:

a sole insert configured to attach to the shell and cover the sole opening; and a crown insert configured to attach to the shell and cover the crown opening.

16. The golf club head of claim 1, wherein the weight comprises a material having a density that is greater than a density of the weighted insert.

17. The golf club head of claim 16, wherein the shell further comprises one or more trusses located in the interior of the hollow body, each of the one or more trusses extending between an interior surface of the recess and an interior surface of a channel, the channel being disposed rearward the recess in a front-to-rear direction.

18. The golf club head of claim 1, wherein:

the shell comprises a protrusion extending outwardly from the shell, the protrusion including a weight opening, and the golf club head further comprises a secondary weight configured to at least partially insert into the weight opening and extend into the interior of the hollow body, the secondary weight having a generally longitudinal shape.

19. A golf club head comprising:

a hollow body comprising a shell defining at least some of an exterior surface of the golf club head, the hollow body including a ball-striking face, a crown, a hosel, a sole, and a rear end opposite the ball-striking face;

a recess located on the sole, the recess extending inwardly toward an interior of the hollow body from the sole to an inner end of the recess;

an opening located within the recess and extending inwardly from the inner end toward the interior of the hollow body, the opening being defined by one or more sidewalls; and a weighted insert configured to insert into the recess and the opening, the weighted insert comprising:

an insert body comprising a resiliently deformable material and a UV-resistant additive;

a protrusion extending from an inner-facing surface of the insert body and extending at least partially into the opening; and a weight disposed at least partially within the insert body and the protrusion.

20. The golf club head of claim 1, wherein a vertical distance between a lowermost edge of the ball-striking face and a lowermost point on the sole is greater than a vertical distance between an innermost end of the one or more sidewalls defining the opening and the lowermost point of the sole.

* * * * *